US010525720B2

(12) United States Patent
Udagawa

(10) Patent No.: US 10,525,720 B2
(45) Date of Patent: Jan. 7, 2020

(54) LIQUID EJECTING APPARATUS AND MAINTENANCE METHOD FOR LIQUID EJECTING APPARATUS

(71) Applicant: SEIKO EPSON CORPORATION, Tokyo (JP)

(72) Inventor: Tomoki Udagawa, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/997,234

(22) Filed: Jun. 4, 2018

(65) Prior Publication Data

US 2018/0345677 A1 Dec. 6, 2018

(30) Foreign Application Priority Data

Jun. 2, 2017 (JP) ..... 2017-110243

(51) Int. Cl.
*B41J 2/175* (2006.01)
*B41J 2/165* (2006.01)

(52) U.S. Cl.
CPC ..... *B41J 2/17596* (2013.01)

(58) Field of Classification Search
CPC ..... B41J 2/16526
See application file for complete search history.

(56) References Cited

U.S. PATENT DOCUMENTS 6,179,406 B1 * 1/2001 Ito ..... B41J 2/1707 347/35
2003/0146958 A1 8/2003 Aruga et al.
2009/0147053 A1 6/2009 Yokouchi
2010/0020126 A1 * 1/2010 Takahashi ..... B41J 2/16532 347/30
2012/0026221 A1 * 2/2012 Igarashi ..... B41J 2/16526 347/6
2012/0026256 A1 * 2/2012 Shibata ..... B41J 2/17596 347/85
2012/0056933 A1 3/2012 Tanaka et al.
2012/0127242 A1 5/2012 Koike et al.
2015/0077462 A1 3/2015 Suzuki
2015/0085025 A1 3/2015 Ando
2017/0151806 A1 * 6/2017 Kobayashi ..... B41J 2/16535
(Continued)

FOREIGN PATENT DOCUMENTS

JP 11-129502 A 5/1999
JP 2004-142405 A 5/2004
JP 2009-160912 A 7/2009
(Continued)

*Primary Examiner* — Shelby L Fidler
(74) *Attorney, Agent, or Firm* — Workman Nydegger

(57) ABSTRACT

A liquid ejecting apparatus includes a liquid ejecting unit provided with a nozzle from which liquid is ejected, a liquid supply flow path connected to a liquid supply source and the liquid ejecting unit, and a pump mechanism that includes a pump chamber provided in the liquid supply flow path and that repeats a suction driving operation and a discharge driving operation such that the liquid flows toward the liquid ejecting unit from the liquid supply source. Before maintenance of the liquid ejecting unit is performed by discharging liquid from the nozzle, the pump mechanism performs the suction driving operation until the amount of liquid accommodated in the pump chamber reaches a set value, which is set in advance.

8 Claims, 17 Drawing Sheets

(56) References Cited

U.S. PATENT DOCUMENTS

2017/0266979 A1* 9/2017 Hori ..... B41J 2/17596

FOREIGN PATENT DOCUMENTS

| | | | |
|---|---|---|---|
| JP | 2009-178889 | A | 8/2009 |
| JP | 2009-226625 | A | 10/2009 |
| JP | 2011-240565 | A | 12/2011 |
| JP | 2012-051274 | A | 3/2012 |
| JP | 2012-111044 | A | 6/2012 |
| JP | 2012-166509 | A | 9/2012 |
| JP | 2013-091281 | A | 5/2013 |
| JP | 2014-162006 | A | 9/2014 |
| JP | 2015-054498 | A | 3/2015 |
| JP | 2015-058657 | A | 3/2015 |
| JP | 2015-080862 | A | 4/2015 |
| JP | 2017-024358 | A | 2/2017 |

* cited by examiner

LIQUID EJECTING APPARATUS AND MAINTENANCE METHOD FOR LIQUID EJECTING APPARATUS

BACKGROUND

1. Technical Field

The present invention relates to a liquid ejecting apparatus such as a printer and a maintenance method for a liquid ejecting apparatus.

2. Related Art

There is a liquid ejecting apparatus that is provided with a liquid ejecting head including a nozzle from which liquid is ejected and a pump supplying liquid to the liquid ejecting head by repeating a suction driving operation and a discharge driving operation (for example, JP-A-2009-160912).

It is possible to perform maintenance of a liquid ejecting head by supplying liquid and discharging liquid from a nozzle with a pump performing a discharge driving operation. In this case, if the amounts of liquid accommodated in pump chambers are different from each other at a time when the pump starts the discharge driving operation, the way in which liquid flows does not become constant at the time of the discharge driving operation thereafter. Therefore, the maintenance cannot be performed appropriately.

SUMMARY

An advantage of some aspects of the invention is to provide a liquid ejecting apparatus and a maintenance method for a liquid ejecting apparatus with which it is possible to perform favorable maintenance of a liquid ejecting unit.

According to an aspect of the invention, there is provided a liquid ejecting apparatus including a liquid ejecting unit provided with a nozzle from which liquid is ejected, a liquid supply flow path connected to a liquid supply source and the liquid ejecting unit, and a pump mechanism that includes a pump chamber provided in the liquid supply flow path and that repeats a suction driving operation and a discharge driving operation such that the liquid flows toward the liquid ejecting unit from the liquid supply source, in which, before maintenance of the liquid ejecting unit is performed by discharging liquid from the nozzle, the pump mechanism performs the suction driving operation until the amount of liquid accommodated in the pump chamber reaches a set value, which is set in advance.

According to another aspect of the invention, there is provided a maintenance method for a liquid ejecting apparatus which includes a liquid ejecting unit provided with a nozzle from which liquid is ejected, a liquid supply flow path connected to a liquid supply source and the liquid ejecting unit, a pump mechanism that includes a pump chamber provided in the liquid supply flow path and that repeats a suction driving operation and a discharge driving operation such that the liquid flows toward the liquid ejecting unit from the liquid supply source, and a pressure adjustment mechanism that adjusts a pressure in the liquid ejecting unit by opening and closing the liquid supply flow path between the pump chamber and the liquid ejecting unit, the method including causing the pump mechanism to perform the suction driving operation until the amount of liquid accommodated in the pump chamber reaches a set value, causing the pressure adjustment mechanism to open the liquid supply flow path after the suction driving operation, and causing the pump mechanism to perform the discharge driving operation after the liquid supply flow path is opened such that the liquid is discharged from the nozzle.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting apparatus will be described with reference to drawings. The liquid ejecting apparatus is, for example, an ink jet printer which performs printing on a medium such as a paper sheet by ejecting ink, which is an example of liquid.

First Embodiment

Figure 1:
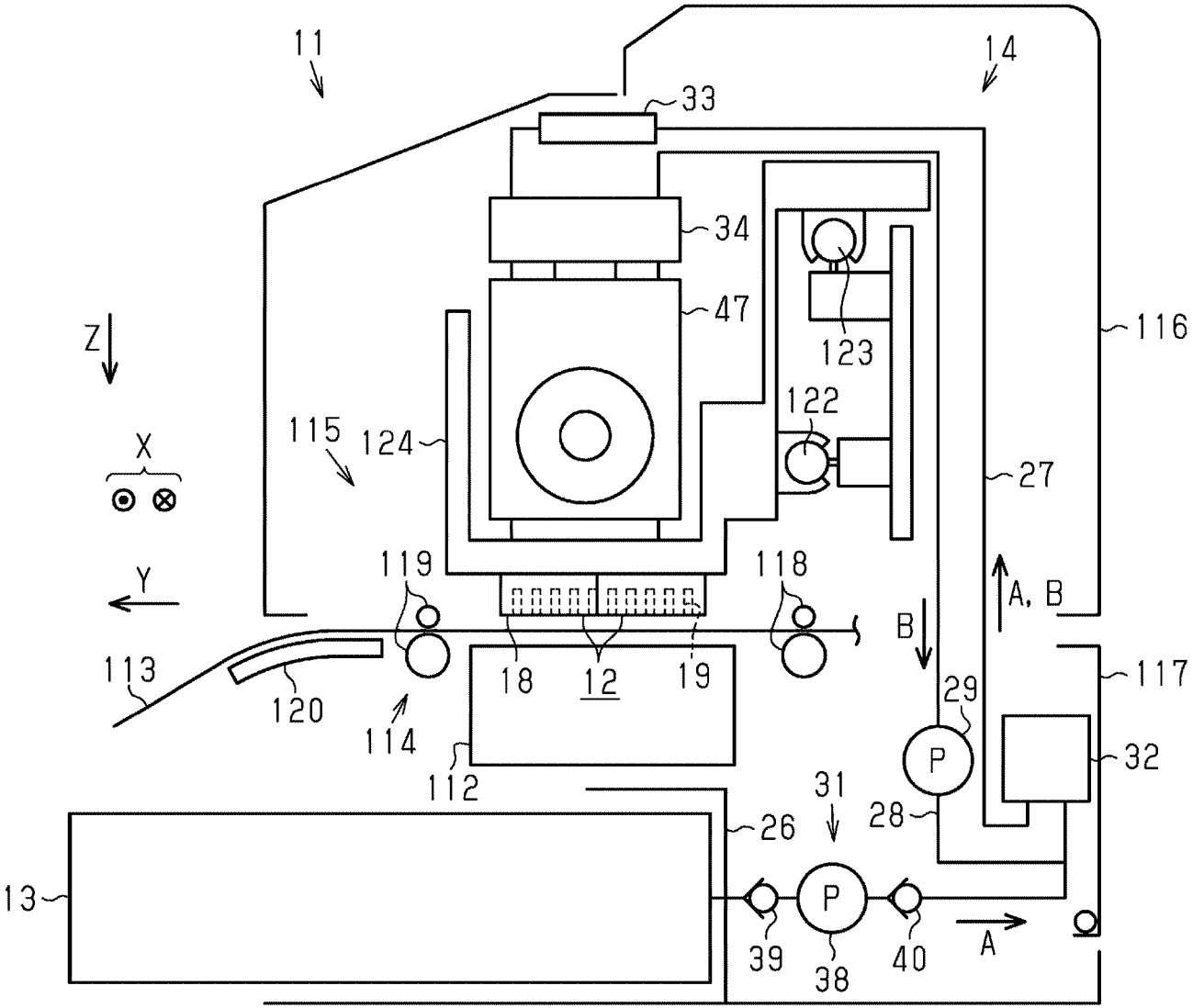
FIG. 1 is a schematic view of a liquid ejecting apparatus according to a first embodiment.

As illustrated in FIG. 1, a liquid ejecting apparatus 11 includes liquid ejecting units 12 that eject liquid and a supply mechanism 14 that supplies liquid from a liquid supply source 13 to the liquid ejecting units 12. Furthermore, the liquid ejecting apparatus 11 includes a supporting table 112 that is disposed at a position facing the liquid ejecting units 12, a transporting unit 114 that transports a medium 113 in a transportation direction Y, and a printing unit 115 that performs printing by ejecting liquid onto the medium 113 with the liquid ejecting units 12 moving in a scanning direction X.

The supporting table 112 extends in a width direction of the medium 113 (the scanning direction X) that is a direction orthogonal to (intersecting) the transportation direction Y of the medium 113. The supporting table 112, the transporting unit 114, and the printing unit 115 are assembled into a main body 116 that is configured of a housing, a frame, or the like. The main body 116 is provided with a cover 117 such that the cover 117 can be opened and closed.

The transporting unit 114 includes pairs of transportation rollers 118 and 119 that are respectively disposed on the upstream side and the downstream side of the supporting table 112 in the transportation direction Y, and a guide plate 120 that is disposed on the downstream side of the pair of transportation rollers 119 and guides the medium 113. In addition, when the pairs of transportation rollers 118 and 119 rotate while nipping the medium 113 by being driven by a transportation motor (not shown), the medium 113 is transported along a surface of the supporting table 112 and a surface of the guide plate 120 while being supported by the supporting table 112 and the guide plate 120.

The printing unit 115 includes guide shafts 122 and 123 extending in the scanning direction X and a carriage 124 that can reciprocate in the scanning direction X while being guided by the guide shafts 122 and 123. The carriage 124 moves when a carriage motor (not shown) is driven. At least one (two in the first embodiment) liquid ejecting unit 12 is attached to a lower end portion of the carriage 124, which is an end portion of the carriage 124 on a vertical direction Z side. The two liquid ejecting units 12 are disposed to be separated from each other by a predetermined distance in the scanning direction X and are offset from each other by a predetermined distance in the transportation direction Y. In addition, each liquid ejecting unit 12 is provided with a plurality of nozzles 19 from which liquid is ejected in the form of liquid droplets and a nozzle surface 18 in which the nozzles 19 are opened.

Figure 2:
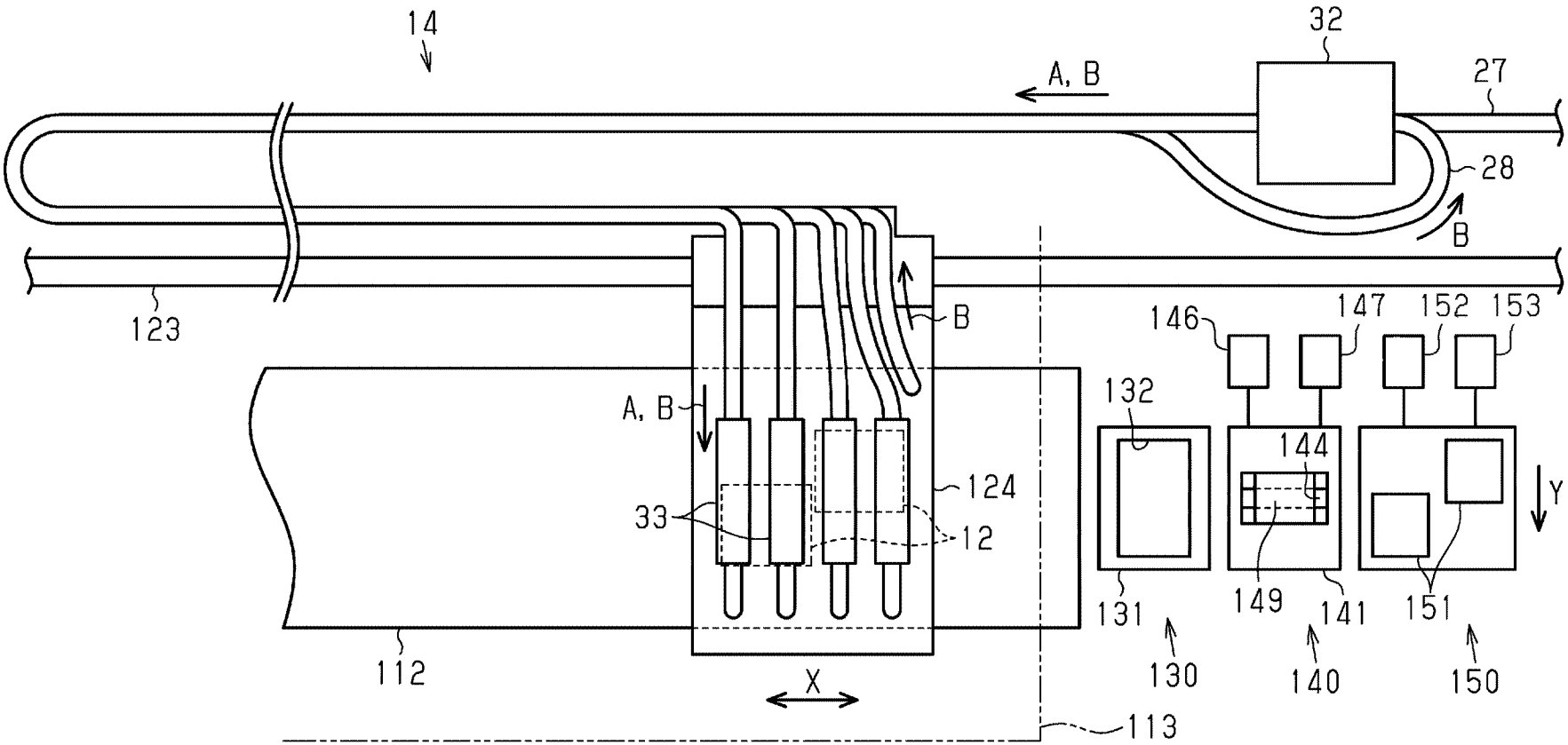
FIG. 2 is a schematic plan view of a printing region and a non-printing region.

As illustrated in FIG. 2, a flushing mechanism 130, a wiping mechanism 140, and a cap mechanism 150 are provided in a non-printing region in the scanning direction X that is a region in which the liquid ejecting units 12 do not face the medium 113 in the middle of transportation.

Note that, the flushing is a maintenance operation of discharging liquid from the nozzles 19 not for printing in order to prevent or resolve clogging or the like in the nozzles 19. The flushing mechanism 130 includes a liquid receiving unit 131 that receives liquid ejected from the liquid ejecting units 12 at the time of flushing. The liquid receiving unit 131 has a box-like shape that includes an opening 132.

Figure 3:
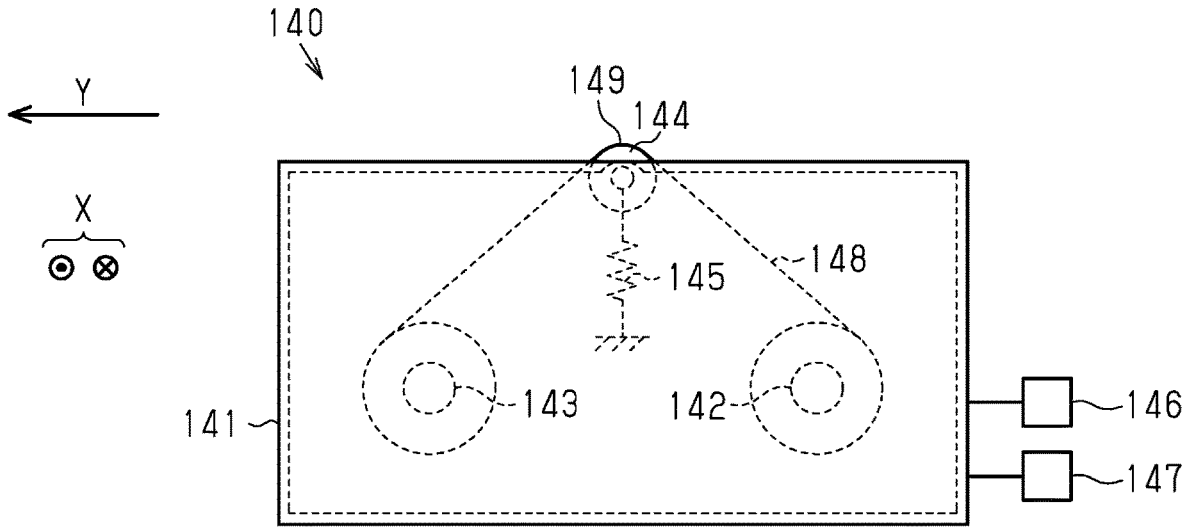
FIG. 3 is a side view of a wiping mechanism.

As illustrated in FIG. 3, the wiping mechanism 140 includes a box-shaped housing 141, a feeding roller 142 that is disposed on one end side in a depth direction (a right-left direction in FIG. 3) of the housing 141, a winding roller 143 that is disposed on the other end side in the depth direction in the housing 141, and an intermediate roller 144 that is positioned to be exposed through an opening of the housing 141. In addition, the wiping mechanism 140 includes an urging member 145 that urges the intermediate roller 144 toward the outside of the housing 141, a first windshield wiper driving unit 146 that is driven when the housing 141 advances or retreats, and a second windshield wiper driving unit 147 that is driven when a gap between the wiping mechanism 140 and the nozzle surface 18 in the vertical direction Z is adjusted.

The feeding roller 142, the winding roller 143, and the intermediate roller 144 are rotatably supported by the housing 141 such that the axial directions thereof become parallel to each other. On the feeding roller 142, a fabric wiper 148 that absorbs or holds liquid is wound in a roll shape. An intermediate portion of the fabric wiper 148 unwound from the feeding roller 142 is suspended on the intermediate roller 144 and a leading end thereof is wound on the winding roller 143. A portion of the fabric wiper 148, which is suspended on the intermediate roller 144, will be referred to as a wiping portion 149. A maintenance operation of wiping the nozzle surface 18 with the wiping portion 149 relatively moving will be referred to as wiping. The winding roller 143 rotates to wind the fabric wiper 148 fed from the feeding roller 142.

In addition, when the first windshield wiper driving unit 146 and the second windshield wiper driving unit 147 are driven in a state where the carriage 124 has been moved such that the liquid ejecting units 12 are positioned above the wiping mechanism 140, the wiping portion 149 relatively moves with respect to the liquid ejecting units 12 and the nozzle surfaces 18 are wiped. In addition, when the wiping portion 149 absorbs liquid with the nozzle surfaces 18 being wiped, the winding roller 143 is driven to rotate and the used wiping portion 149 is wound on the winding roller 143. Accordingly, an unused portion of the fabric wiper 148 is suspended on the intermediate roller 144 and the unused portion newly becomes the wiping portion 149.

As illustrated in FIG. 2, the cap mechanism 150 includes two bottomed quadrangular box-shaped caps 151 each of which covers openings of the nozzles 19 of each of the two liquid ejecting units 12, a cap driving unit 152 that lifts or lowers the caps 151, and a suction mechanism 153 that sucks air or the like in the caps 151. When the cap driving unit 152 lifts the two caps 151 in a state where the carriage 124 has been moved to positions at which the two liquid ejecting units 12 respectively face the corresponding caps 151, the two caps 151 respectively abut onto the nozzle surfaces 18 of the two liquid ejecting units 12 to cover all of the nozzles 19. An operation of covering the nozzles 19 with the caps 151 as described above will be referred to as capping.

Each cap 151 can cover a region including all of the nozzles 19 on the nozzle surface 18 of each liquid ejecting unit 12. When the suction mechanism 153 is driven at the time of the capping, a negative pressure generated in the caps 151 reaches the inside of the nozzles 19 and thus liquid or the like in the liquid ejecting units 12 are sucked. A maintenance operation of discharging liquid in the liquid ejecting units 12 and foreign substances such as air bubbles included in the like from the nozzles 19 through the suction will be referred to as suction cleaning.

Next, the liquid ejecting unit 12 will be described in detail.

Figure 4:
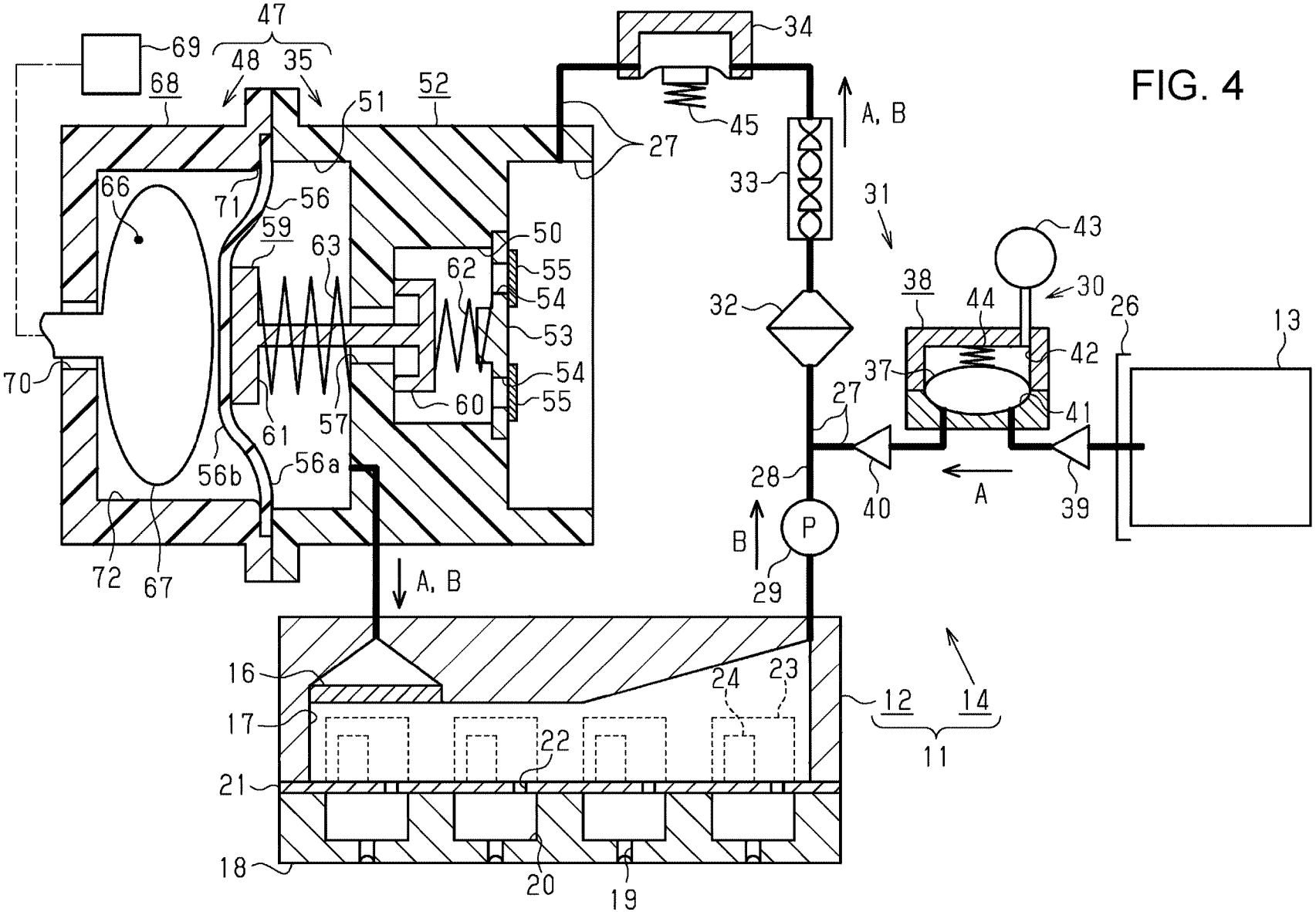
FIG. 4 is a schematic view of a pressure adjustment mechanism and a supply mechanism with an on-off valve closed.

As illustrated in FIG. 4, the liquid ejecting unit 12 includes an ejecting unit filter 16 that captures foreign substances such as air bubbles in liquid and a common liquid chamber 17 that stores liquid passing through the ejecting unit filter 16. The liquid ejecting unit 12 is provided with a plurality of pressure chambers 20 which are positioned between the plurality of nozzles 19 opened in the nozzle surface 18 and the common liquid chamber 17, a vibration plate 21 that forms a portion of wall surfaces of each pressure chamber 20, and communication holes 22 through which the common liquid chamber 17 and the pressure chambers 20 communicate with each other. The liquid ejecting unit 12 is provided with accommodation chambers 23, which are disposed on a surface of the vibration plate 21 that is opposite to a portion that faces the pressure chambers 20 and which are disposed at positions different from that of the common liquid chamber 17, and actuators 24 accommodated in the accommodation chambers 23.

Note that, a right-left direction in FIG. 4 corresponds to the vertical direction (a gravity direction) and a lower side in the vertical direction is a right side in FIG. 4.

Each actuator 24 in the first embodiment is configured of a piezoelectric element that contracts when drive voltage is applied thereto. In addition, when application of drive voltage to the actuators 24 is stopped after the vibration plate 21 is deformed with the actuators 24 contracting due to the application of the drive voltage, liquid in the pressure chamber 20 of which the volume has been changed is ejected from the nozzle 19 as liquid droplets. That is, each liquid ejecting unit 12 drives the actuator 24 to eject liquid from the nozzles 19.

The liquid supply source 13 is, for example, an accommodation container that can accommodate liquid. The liquid supply source 13 may be a cartridge to which liquid is supplied by means of replacement of the accommodation container and may be an accommodation tank fixed to a mounting portion 26. In a case where the liquid supply source 13 is the cartridge, the mounting portion 26 detachably holds the liquid supply source 13. Note that, at least one set (four sets in the first embodiment) of the liquid supply source 13 and the supply mechanism 14 is provided for each type of liquid to be ejected from the liquid ejecting units 12.

In addition, the supply mechanism 14 includes a liquid supply flow path 27 that is connected to the liquid supply source 13 and the liquid ejecting units 12 such that liquid can be supplied from the liquid supply source 13 which is on the upstream side in a supply direction A of liquid to the liquid ejecting units 12 which is on the downstream side. A portion of the liquid supply flow path 27 also functions as a circulation path in cooperation with a circulation path forming portion 28. The circulation path forming portion 28 is connected to the common liquid chamber 17 and the liquid supply flow path 27. The circulation path forming portion 28 is provided with a circulation pump 29 that circulates liquid in a circulation direction B in the circulation path.

A pump mechanism 31, which causes liquid to flow in the supply direction A from the liquid supply source 13 such that the liquid is supplied to the liquid ejecting units 12 in a pressurizing manner, is provided closer to the liquid supply source 13 side than a position at which the circulation path forming portion 28 is connected to the liquid supply flow path 27. Furthermore, a portion of the liquid supply flow path 27 that is disposed on the downstream side of the position at which the circulation path forming portion 28 is connected to the liquid supply flow path 27 and that also functions the circulation path is provided with a filter unit 32, a static mixer 33, a liquid storing unit 34, and a pressure adjustment device 47, which are arranged in this order from the upstream side.

The pump mechanism 31 is provided with a volume pump 38 and one-way valves 39 and 40. The volume pump 38 is provided with a pump chamber 41 that is provided in the middle of the liquid supply flow path 27, a displacement portion 37 that constitutes a portion of wall surfaces of the pump chamber 41, a displacement mechanism 30 that displaces the displacement portion 37 in a direction in which the volume of the pump chamber 41 is increased, and an urging member 44 that urges the displacement portion 37 in a direction in which the volume of the pump chamber 41 is decreased. The displacement portion 37 is disposed such that the displacement portion 37 can be displaced in a direction in which the volume of the pump chamber 41 is changed.

The displacement mechanism 30 is provided with a pressure reduction chamber 42 that is separated from the pump chamber 41 by the displacement portion 37 and a pressure reduction unit 43 for reducing the pressure in the pressure reduction chamber 42. The displacement mechanism 30 displaces the displacement portion 37 by adjusting the pressure in the pressure reduction chamber 42. For example, when the pressure reduction unit 43 reduces the pressure in the pressure reduction chamber 42, the displacement portion 37 is displaced in a direction in which the volume of the pump chamber 41 is increased. The urging member 44 may be disposed in the pressure reduction chamber 42.

The one-way valve 39 is a first one-way valve that is provided between the liquid supply source 13 and the pump chamber 41, allows liquid to flow into the pump chamber 41, and restrains liquid from flowing out from the pump chamber 41. The one-way valve 40 is a second one-way valve that is provided between the pump chamber 41 and the liquid ejecting unit 12, allows liquid to flow out from the pump chamber 41, and restrains liquid from flowing into the pump chamber 41.

When the pressure reduction unit 43 reduces the pressure in the pressure reduction chamber 42, the displacement portion 37 moves in a direction in which the volume of the pump chamber 41 is increased. Accordingly, the one-way valve 39 is opened, the one-way valve 40 is closed, and liquid flows into the pump chamber 41 from the liquid supply source 13. This will be referred to as a suction driving operation of the pump mechanism 31. When the pressure reduction unit 43 stops the pressure reduction after the suction driving operation, the displacement portion 37 is displaced in a direction in which the volume of the pump chamber 41 is decreased due to an urging force of the urging member 44. Accordingly, the one-way valve 40 is opened, the one-way valve 39 is closed, and liquid flows out from the pump chamber 41. This will be referred to as a discharge driving operation of the pump mechanism 31. The pump mechanism 31 repeats the suction driving operation and the discharge driving operation such that liquid flows toward the liquid ejecting unit 12 from the liquid supply source 13.

The pump mechanism 31 pressurizes liquid to be supplied to the pressure adjustment device 47 with the urging member 44 urging liquid in the pump chamber 41 via the displacement portion 37. Therefore, the pressurizing force at which the pump mechanism 31 pressurizes the liquid by means of the discharge driving operation is set by using an urging force of the urging member 44. In addition, in this regard, it can be said that the pump mechanism 31 can pressurize liquid in the liquid supply flow path 27 in the first embodiment.

The filter unit 32 captures air bubbles and foreign substances in liquid flowing in the liquid supply flow path 27. The filter unit 32 is preferably replaceable. The static mixer 33 causes changes such as direction reversal or division in the flow of the liquid and reduces concentration bias in the liquid. The liquid storing unit 34 stores liquid in a space with variable volume that is urged by a spring 45 and alleviates a fluctuation in pressure of the liquid.

Next, the pressure adjustment device 47 will be described in detail.

As illustrated in FIG. 4, the pressure adjustment device 47 is provided with a pressure adjustment mechanism 35 that includes a main body portion 52 and a pressing mechanism 48. The pressure adjustment mechanism 35 adjusts the pressure in the liquid ejecting unit 12 by opening and closing the liquid supply flow path 27 between the pump chamber 41 and the liquid ejecting unit 12. The main body portion 52 is provided with a liquid inflow portion 50 that is disposed in the middle of the liquid supply flow path 27 and a liquid outflow portion 51 that is disposed in the liquid supply flow path 27 between the liquid inflow portion 50 and the liquid ejecting unit 12. The pressure adjustment device 47 is provided with a diaphragm 56 that constitutes a portion of a wall surface of the liquid outflow portion 51 and an on-off valve 59 that opens or closes the liquid supply flow path 27 between the liquid inflow portion 50 and the liquid outflow portion 51.

The liquid supply flow path 27 and the liquid inflow portion 50 are separated from each other by a wall portion 53 and communicate with each other via through holes 54 formed in the wall portion 53. The through holes 54 are covered by filter members 55. Therefore, liquid in the liquid supply flow path 27 flows into the liquid inflow portion 50 while being filtered by the filter members 55.

A surface of the diaphragm 56 that is close to the inside of the liquid outflow portion 51 will be referred to as a first surface 56*a* and a surface opposite to the first surface 56*a* will be referred to as a second surface 56*b*. The first surface 56*a* of the diaphragm 56 receives the pressure of liquid in the liquid outflow portion 51 and the second surface 56*b*, which is an outer surface of the liquid outflow portion 51, receives atmospheric pressure. Therefore, the diaphragm 56 is displaced in response to the pressure in the liquid outflow portion 51. The volume of the liquid outflow portion 51 changes when the diaphragm 56 is displaced. The liquid inflow portion 50 and the liquid outflow portion 51 communicate with each other via a communication path 57, which is a portion of the liquid supply flow path 27.

The on-off valve 59 can switch between a closed state (a state illustrated in FIG. 4) in which the liquid inflow portion 50 and the liquid outflow portion 51 do not communicate with each other via the communication path 57 and an opened state (a state illustrated in FIG. 7) in which the liquid inflow portion 50 and the liquid outflow portion 51 communicate with each other. The on-off valve 59 includes a valve portion 60 that can block the communication path 57 and a pressure receiving portion 61 that receives pressure from the diaphragm 56, and moves in a direction in which the volume of the liquid outflow portion 51 is decreased when the pressure receiving portion 61 is pressed by the diaphragm 56. That is, the pressure receiving portion 61 also functions as a moving member that can move in a state of being in contact with the diaphragm 56 that is displaced in a direction in which the volume of the liquid outflow portion 51 is reduced.

An upstream side urging member 62 is provided in the liquid inflow portion 50 and a downstream side urging member 63 is provided in the liquid outflow portion 51. The upstream side urging member 62 and the downstream side urging member 63 urge the on-off valve 59 in a direction in which the on-off valve 59 is closed. The on-off valve 59 opens the communication path 57 when a pressure applied to the first surface 56*a* of the diaphragm 56 is lower than a pressure applied to the second surface 56*b* and a difference between the pressure applied to the first surface 56*a* and the pressure applied to the second surface 56*b* is equal to or greater than a predetermined value P1 (for example, 1 kPa).

The predetermined value P1 is a value determined according to the urging force of the upstream side urging member 62, the urging force of the downstream side urging member 63, a force required to displace the diaphragm 56, a pressing force (sealing load) required to block the communication path 57 with the valve portion 60, the pressure in the liquid inflow portion 50 which acts on a surface of the valve portion 60, and the pressure in the liquid outflow portion 51. That is, the predetermined value P1 increases as the urging forces of the upstream side urging member 62 and the downstream side urging member 63 increase.

The urging forces of the upstream side urging member 62 and the downstream side urging member 63 are set such that the pressure in the liquid outflow portion 51 becomes a negative pressure (in a case where a pressure applied to the second surface 56*b* is atmospheric pressure, −1 kPa) at which a meniscus can be formed on a gas-liquid interface in the nozzle 19. In this case, the gas-liquid interface is a boundary at which the liquid and the gas are in contact with each other and the meniscus is a curved liquid surface which is generated when liquid comes into contact with the nozzle 19. In addition, it is preferable that a concave meniscus suitable for liquid ejection be formed in the nozzle 19.

In the first embodiment, in a case where the on-off valve 59 is in the closed state, the pressure of liquid in the liquid inflow portion 50 is maintained at a positive pressure due to the pump mechanism 31 and the pressure of liquid in an area from the liquid outflow portion 51 to the nozzle 19 is maintained at a negative pressure due to the pressure adjustment mechanism 35. Therefore, the pressure in the liquid ejecting unit 12 is normally negative at the time of a printing operation or at a stand-by time.

In addition, when the liquid ejecting unit 12 ejects liquid in a state as illustrated in FIG. 4, liquid accommodated in the liquid outflow portion 51 is supplied to the liquid ejecting unit 12 via the liquid supply flow path 27. As a result, the pressure in the liquid outflow portion 51 is reduced and when a difference between a pressure applied to the first surface 56*a* of the diaphragm 56 and a pressure applied to the second surface 56*b* becomes equal to or greater than the predetermined value P1, the diaphragm 56 is bent and deformed in a direction in which the volume of the liquid outflow portion 51 is reduced. When the pressure receiving portion 61 is moved by being pressed by the diaphragm 56 being displaced, the on-off valve 59 opens the communication path 57.

Since the liquid in the liquid inflow portion 50 is pressurized by the pump mechanism 31, when the on-off valve 59 opens the communication path 57, liquid flows into the liquid outflow portion 51 from the liquid inflow portion 50 and the pressure in the liquid outflow portion 51 increases. Accordingly, the diaphragm 56 is deformed in a direction in which the volume of the liquid outflow portion 51 increases. Then, when the difference between the pressure applied to the first surface 56*a* of the diaphragm 56 and the pressure applied to the second surface 56*b* becomes lower than the predetermined value P1, the on-off valve 59 closes the communication path 57 and liquid is inhibited from flowing.

As described above, the pressure adjustment mechanism 35 adjusts the pressure of liquid supplied to the liquid ejecting unit 12 with the diaphragm 56 being displaced in accordance with the internal pressure of the liquid outflow portion 51. Therefore, the pressure in the liquid ejecting unit 12, in which the nozzle 19 causes a back pressure, is maintained at a negative pressure close to the predetermined value P1.

As illustrated in FIG. 4, the pressing mechanism 48 includes an expansion and contraction portion 67 that forms a pressure adjustment chamber 66 which is positioned close to the second surface 56*b* of the diaphragm 56, a retaining member 68 that retains the expansion and contraction portion 67, and a pressure adjustment unit 69 that can adjust the pressure in the pressure adjustment chamber 66. The expansion and contraction portion 67 is formed of rubber or resin and is formed into a balloon-like shape. The expansion and contraction portion 67 expands or contracts in response to adjustment of the pressure in the pressure adjustment chamber 66 which is performed by the pressure adjustment unit 69. The retaining member 68 has a bottomed cylindrical shape and a portion of the expansion and contraction portion 67 is inserted into an insertion hole 70 formed in the bottom portion thereof.

An end edge portion of an inner surface of the retaining member 68 that is on an opening portion 71 side is given roundness through R-chamfering. The retaining member 68 forms an air chamber 72 that covers the second surface 56*b* of the diaphragm 56 by being attached to the pressure adjustment mechanism 35 such that the opening portion 71 is blocked by the pressure adjustment mechanism 35. The pressure in the air chamber 72 is set to atmospheric pressure and the atmospheric pressure acts on the second surface 56*b* of the diaphragm 56.

That is, the pressure adjustment unit 69 causes the expansion and contraction portion 67 to expand by adjusting the pressure in the pressure adjustment chamber 66 to be higher than the atmospheric pressure which is the pressure in the air chamber 72. The pressing mechanism 48 presses the diaphragm 56 in a direction in which the volume of the liquid outflow portion 51 is reduced with the pressure adjustment unit 69 causing the expansion and contraction portion 67 to expand. At this time, the expansion and contraction portion 67 of the pressing mechanism 48 presses a region of the diaphragm 56 that comes into contact with the pressure receiving portion 61. The area of the region of the diaphragm 56 that comes into contact with the pressure receiving portion 61 is greater than the cross-sectional area of the communication path 57. As described above, the pressing mechanism 48 presses the diaphragm 56 in a direction in which the volume of the liquid outflow portion 51 is decreased to cause the on-off valve 59 to open the communication path 57, which is a portion of the liquid supply flow path 27.

Figure 5:
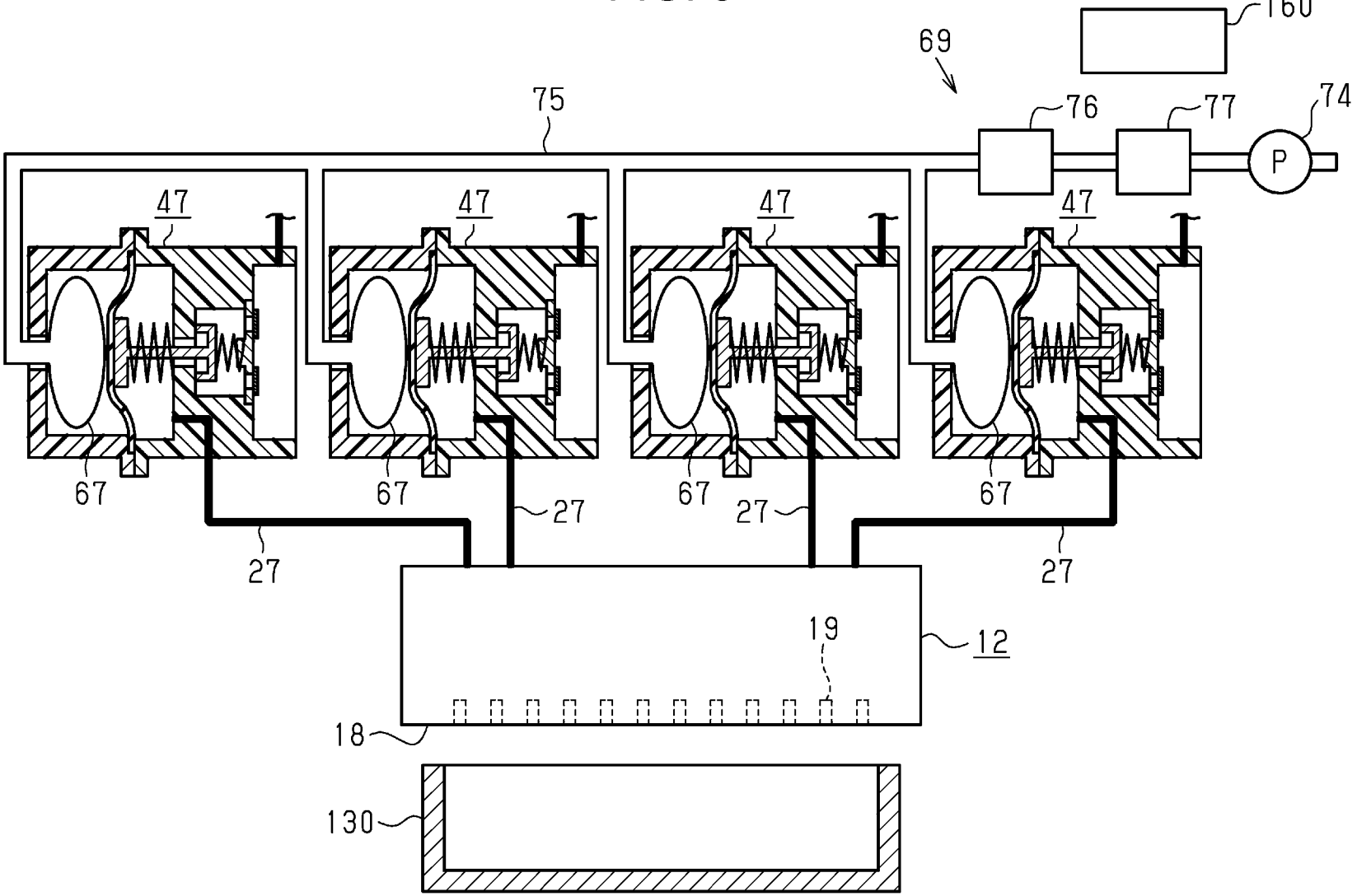
FIG. 5 is a schematic view of a plurality of pressure adjustment mechanisms and a pressure adjustment unit.

As illustrated in FIG. 5, the pressure adjustment unit 69 includes a pressurizing pump 74 that pressurizes fluid such as air or water, a connection path 75 that connects the pressurizing pump 74 and the expansion and contraction portions 67 to each other, a detecting unit 76 provided in the connection path 75, and a fluid pressure adjustment unit 77. The fluid pressure adjustment unit 77 is provided between the detecting unit 76 and the pressurizing pump 74 in the connection path 75. The connection path 75 branches into a plurality of (in the first embodiment, four) flow paths at a position on the downstream side of the detecting unit 76 and the flow paths are respectively connected to the expansion and contraction portions 67. The number of branches of the connection path 75 coincides with the number (in the first embodiment, four) of the expansion and contraction portions 67 of the pressure adjustment device 47. Note that, a changeover valve (not shown) that switches the state of a flow path between a communication state and a non-communication state may be provided for each of the plurality of flow paths which are branches of the connection path 75. In this case, it is also possible to selectively supply pressurized fluid to the plurality of expansion and contraction portions 67 by controlling the changeover valves.

Note that, a right-left direction in FIG. 5 corresponds to the vertical direction (the gravity direction) and the lower side in the vertical direction is a right side in FIG. 5.

That is, fluid pressurized by the pressurizing pump 74 is supplied to the plurality of the expansion and contraction portions 67 via the connection path 75. The detecting unit 76 measures the pressure of fluid in the connection path 75. The fluid pressure adjustment unit 77 is configured of, for example, a safety valve. In addition, the fluid pressure adjustment unit 77 reduces the pressure of fluid in the connection path 75 by releasing the fluid in the connection path 75 to the outside in a case where the pressure of the fluid in the connection path 75 becomes higher than a predetermined pressure.

As illustrated in FIG. 5, the liquid ejecting apparatus 11 includes a controller 160 that controls the driving of various constituent members of the liquid ejecting apparatus 11. The controller 160 is a microcomputer that includes a CPU, a ROM, a RAM, and the like.

The controller 160 causes a printing operation of forming a character or an image on the medium 113 to be performed by causing a transportation operation of transporting the medium 113 by a unit transportation amount with the transporting unit 114, which is illustrated in FIG. 1, being driven and an ejection operation of ejecting liquid toward the medium 113 from the liquid ejecting unit 12 with the carriage 124 moving in the scanning direction X to be alternately performed.

In addition, the controller 160 drives the pressurizing pump 74 such that pressurized fluid is supplied to the expansion and contraction portion 67 in the pressing mechanism 48 illustrated in FIG. 4. As a result of this, the expansion and contraction portion 67 expands, the diaphragm 56 is displaced in a direction in which the volume of the liquid outflow portion 51 is decreased, and the on-off valve 59 enters the opened state. As described above, the controller 160 performs control to open or close the on-off valve 59 based on the driving of the pressing mechanism 48.

In addition, the controller 160 makes the pressure (pressure of liquid) in the liquid ejecting unit 12 illustrated in FIG. 4 higher than the pressure outside the liquid ejecting unit 12 (for example, atmospheric pressure) to cause a discharging operation of discharging pressurized liquid from the nozzle 19 of the liquid ejecting unit 12 (hereinafter, also referred to as "pressurization cleaning") to be performed. That is, when the discharging operation is performed, the controller 160 causes the pressing mechanism 48 to press the diaphragm 56 such that the on-off valve 59 is opened and liquid pressurized by the pump mechanism 31 is supplied to the pressure adjustment mechanism 35 and the liquid ejecting unit 12.

It is preferable that the pump mechanism 31 perform the suction driving operation and suck liquid until the amount of liquid accommodated in the pump chamber 41 reaches a set value, which is set in advance, before performing maintenance of the liquid ejecting unit 12 by means of the discharging operation of discharging liquid from the nozzles 19. The set value is, for example, the full capacity of the pump chamber 41. In this case, before the discharging operation, the pump mechanism 31 performs the suction driving operation until the displacement portion 37 reaches the top dead point. As described above, when the pump mechanism 31 performs the discharge driving operation after the amount of liquid accommodated in the pump chamber 41 reaches the set value as a result of the suction driving operation performed by the pump mechanism 31, the way in which liquid to be discharged from the nozzles 19 flows can be constant during the discharging operation.

After the discharging operation is performed, the pressure in the liquid ejecting unit 12 is likely to become higher than that at the time of the printing operation. Specifically, the pressure in the liquid ejecting unit 12 becomes a positive pressure higher than the atmospheric pressure after the discharging operation is performed while the pressure in the liquid ejecting unit 12 becomes a negative pressure at the time of the printing operation.

Therefore, in a case where the printing operation is performed after the discharging operation is performed, liquid may be unstably ejected from the nozzle 19 of the liquid ejecting unit 12. For example, the size of a liquid droplet ejected from the nozzle 19 of the liquid ejecting unit 12 may not be a desired size or liquid may not be ejected at a time when the liquid needs to be ejected.

Therefore, in a case where the discharging operation has been performed, the controller 160 may cause a pressure reducing operation of reducing the pressure in the liquid ejecting unit 12 and a portion of the liquid supply flow path 27 that is on the downstream side of the pressure adjustment mechanism 35 to be performed after causing a discharge stopping operation of stopping the discharging operation to be performed. Furthermore, the controller 160 may cause a finishing wiping operation of wiping the nozzle surface 18 of the liquid ejecting unit 12 to be performed in a state where the pressure in the liquid ejecting unit 12 has been reduced due to the pressure reducing operation performed. As a result, the pressure in the liquid ejecting unit 12 becomes an appropriate pressure (a predetermined pressure) before the printing operation is performed and a meniscus suitable for liquid ejection is formed in the nozzle 19 of the liquid ejecting unit 12. Note that, in the pressure reducing operation, the pressure in the liquid ejecting unit 12 may be reduced such that the meniscus formed in the nozzle 19 is positioned in the nozzle 19.

In addition, in a case where the discharging operation is performed for a long period of time, the consumption amount of liquid discharged from the nozzle 19 of the liquid ejecting unit 12 may become excessively large with respect to the supply amount of liquid that the pump mechanism 31 supplies to the liquid ejecting unit 12 and the flow rate of liquid flowing in the liquid supply flow path 27 may gradually decrease. In this case, it may not be possible to effectively discharge air bubbles and foreign substances present in the liquid ejecting unit 12 and the liquid supply flow path 27.

Therefore, it is preferable that the controller 160 cause the discharging operation and the discharge stopping operation of stopping the discharging operation to be repeatedly performed at short intervals. Accordingly, the flow rate of liquid flowing in the liquid supply flow path 27 gradually decreasing is suppressed and an effect of discharging foreign substances such as air bubbles present in the liquid supply flow path 27 becoming weak is suppressed.

Next, the flow of processes that are executed by the controller 160 in the first embodiment when cleaning including the discharging operation is performed will be described with reference to a flowchart in FIG. 6. The series of processes may be performed for each predetermined cycle set in advance, may be performed only in a case where it is expected that there is liquid ejection failure in the nozzle 19, and may be performed manually by an user (an operator) of the liquid ejecting apparatus 11.

Figure 6:
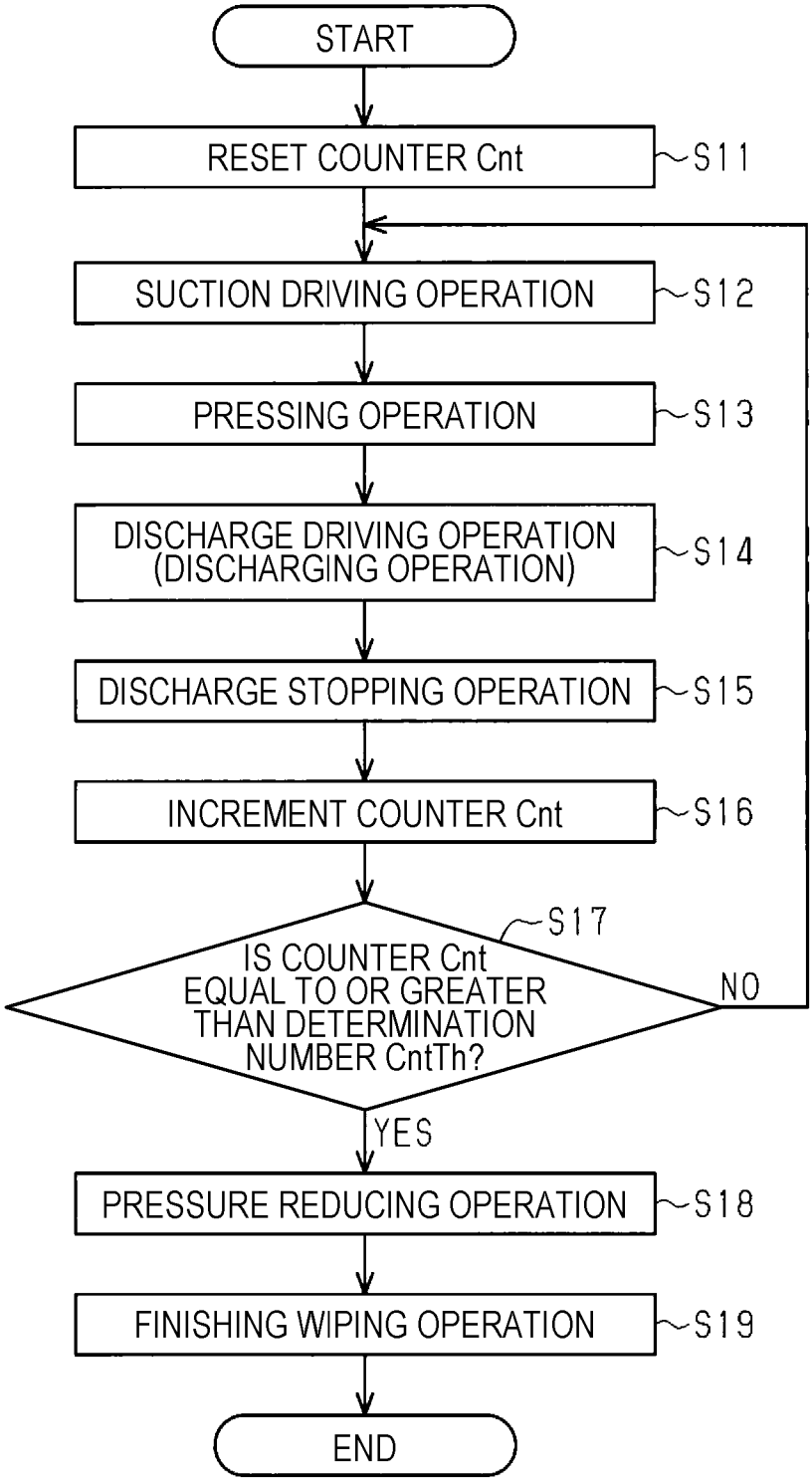
FIG. 6 is a flowchart illustrating the contents of a process that is executed by a controller in order to perform cleaning.

As illustrated in FIG. 6, the controller 160 resets a counter Cnt, which is a variable for counting, to "0 (zero)" (Step S11).

Next, the controller 160 controls the driving of the pressure reduction unit 43 of the pump mechanism 31 and causes the suction driving operation to be performed until the amount of liquid accommodated in the pump chamber 41 reaches the set value (Step S12).

Next, the controller 160 controls the driving of the pressing mechanism 48 such that the diaphragm 56 is pressed in a direction in which the volume of the liquid outflow portion 51 is reduced and the on-off valve 59 opens the liquid supply flow path 27 (Step S13).

Thereafter, the controller 160 stops the pressure reduction performed by the pressure reduction unit 43 such that the discharge driving operation is performed due to an urging force of the urging member 44 (Step S14). The discharge driving operation results in the discharging operation. That is, pressurized liquid flows into the liquid outflow portion 51, the liquid supply flow path 27, the common liquid chamber 17, the pressure chamber 20, and the nozzle 19 and the liquid is discharged from the nozzle 19. Note that, the pressing operation in Step S13 and the discharge driving operation in Step S14 may be performed at the same time.

Next, the controller 160 performs the discharge stopping operation to stop the discharging operation (Step S15). Specifically, the controller 160 controls the driving of the pressing mechanism 48 such that the diaphragm 56 is displaced in a direction in which the volume of the liquid outflow portion 51 increases and the on-off valve 59 enters the closed state. As a result, pressurized liquid is not supplied to the liquid ejecting unit 12. Note that, a period of time between the end of the discharging operation and the start of the discharge stopping operation may be, for example, a period of time of about 0.1 seconds to 1 second.

Then, the controller 160 increments the counter Cnt by "1" (Step S16) and determines whether the counter Cnt is equal to or greater than a determination number CntTh (Step S17). Here, the determination number CntTh is a determination value for determining the number of times the discharging operation and the discharge stopping operation are repeatedly performed. Therefore, the determination number CntTh may be determined based on the specifications of the liquid ejecting apparatus 11 or set by the user. Note that, in a case where it has been detected whether there is liquid ejection failure for every nozzle 19 of the liquid ejecting unit 12, the determination number CntTh may be determined in accordance with the number of defective nozzles in which the liquid ejection failure has occurred.

In a case where the counter Cnt is smaller than the determination number CntTh (NO in Step S17), the process returns to preceding Step S12 and in a case where the counter Cnt is equal to or greater than the determination number CntTh (YES in Step S17), the controller 160 causes the pressure reducing operation to be performed (Step S18). The pressure reducing operation in the first embodiment is a wiping operation (hereinafter, also referred to as a "preceding wiping operation") of wiping the nozzle surface 18 by using the wiping mechanism 140. As a result of the preceding wiping operation, the wiping portion 149 comes into contact with a gas-liquid interface positioned outside the nozzle 19 or in the vicinity of an opening of the nozzle 19, so that pressurized liquid leaks out and the pressure in the liquid ejecting unit 12 is reduced.

Note that, since there is a case where the liquid continues to leak out from the nozzle 19 of the liquid ejecting unit 12 immediately after the last pressure reducing operation, it is preferable that the preceding wiping operation be performed after the liquid stops to leak out. In addition, in the first embodiment, since the pressure reducing operation is performed in a case where the counter Cnt is equal to or greater than the determination number CntTh (YES in Step S17), the pressure reducing operation is performed after the last discharge stopping operation is performed.

Then, the controller 160 causes a wiping operation (hereinafter, also referred to as a "finishing wiping operation") of wiping the nozzle surface 18 by using the wiping mechanism 140 to be performed (Step S19). As a result of the finishing wiping operation, liquid or foreign substances adhering to the nozzle surface 18 is removed and a meniscus suitable for liquid ejection is formed in the nozzle 19. Thereafter, the controller 160 temporarily terminates the series of processes.

As described above, the cleaning in the first embodiment is an operation including the discharging operation, the discharge stopping operation, the pressure reducing operation (the preceding wiping operation), and the finishing wiping operation and is an operation for recovering a liquid ejection performance of the liquid ejecting unit 12. Note that, as maintenance for the liquid ejecting unit 12, the pressurization cleaning (Steps S12, S13, S14, and S15) may be performed alone and the pressure reducing operation (Step S18) or the finishing wiping operation (Step S19) may be omitted. In a case where no wiping operation is performed after the pressurization cleaning, instead of the wiping operation, the flushing may be performed to form the meniscus suitable for liquid ejection in the nozzle 19.

Next, the effect when the liquid ejecting apparatus 11 in the first embodiment performs the cleaning will be described.

When the liquid ejecting apparatus 11 performs the printing operation, a portion of the plurality of nozzles 19 provided in the liquid ejecting unit 12 may become defective nozzles in which liquid ejection failure has occurred. In this case, the cleaning is performed to recover the defective nozzles from the liquid ejection failure.

Figure 7:
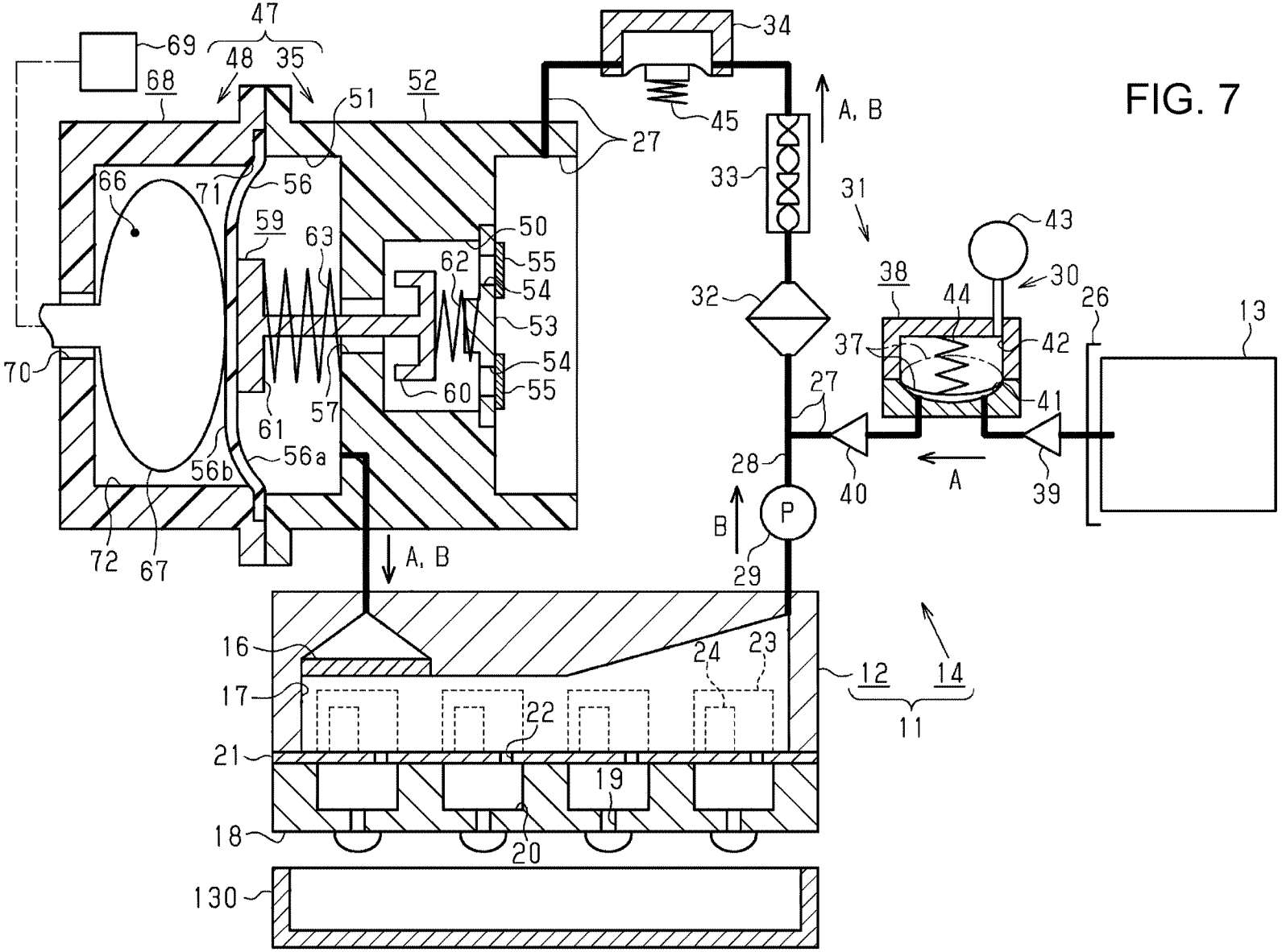
FIG. 7 is a schematic view of the pressure adjustment mechanism and the supply mechanism with the on-off valve opened.

Before the cleaning is performed, the pump mechanism 31 performs the suction driving operation such that the displacement portion 37 moves in a direction in which the volume of the pump chamber 41 is increased as illustrated by a two-dot chain line in FIG. 7 and liquid corresponding to the set value flows into the pump chamber 41. At this time, the one-way valve 40 is closed and the one-way valve 39 is open.

Note that, a right-left direction in FIG. 7 corresponds to the vertical direction (the gravity direction) and the lower side in the vertical direction is a right side in FIG. 7.

When the pressurizing pump 74 is driven in this state, pressurized fluid is supplied to the expansion and contraction portion 67. As a result, the expansion and contraction portion 67 to which the fluid has been supplied expands and presses a region of the diaphragm 56 that comes into contact with the pressure receiving portion 61 such that the on-off valve 59 enters the opened state.

That is, the pressing mechanism 48 moves the pressure receiving portion 61 against urging forces of the upstream side urging member 62 and the downstream side urging member 63 such that the on-off valve 59 enters the opened state. In this case, since the pressure adjustment unit 69 is connected to the expansion and contraction portions 67 of the plurality of pressure adjustment devices 47, all of the on-off valves 59 in the pressure adjustment devices 47 enter the opened state.

At this time, since the diaphragm 56 is displaced in a direction in which the volume of the liquid outflow portion 51 is reduced, liquid accommodated in the liquid outflow portion 51 is pressed out toward the liquid ejecting unit 12 side. That is, a pressure with which the diaphragm 56 presses the liquid outflow portion 51 is transmitted to the liquid ejecting unit 12 and thus the meniscus collapses and liquid flows out from the nozzle 19. In other words, the pressing mechanism 48 presses the diaphragm 56 such that the pressure in the liquid outflow portion 51 becomes higher than a pressure at which at least one meniscus collapses (for example, a pressure at which a liquid side pressure becomes 3 kPa higher than an air side pressure in the gas-liquid interface).

In addition, the pressing mechanism 48 presses the diaphragm 56 such that the on-off valve 59 enters the opened state regardless of the pressure in the liquid inflow portion 50. In this case, the pressing mechanism 48 presses the diaphragm 56 with a pressing force that is greater than a pressing force that is generated in a case where a pressure, which is obtained by adding the above-described predetermined value P1 to a pressure at which the pump mechanism 31 pressurizes liquid, is applied to the diaphragm 56.

While the pressing mechanism 48 presses the diaphragm 56, the opened state of the on-off valve 59 is maintained. When the pump mechanism 31 performs the discharge driving operation in this state, the displacement portion 37 moves to a bottom dead point illustrated with a solid line in FIG. 7. Accordingly, the closed one-way valve 40 is opened and the one-way valve 39 is closed and thus liquid corresponding to a set amount in the pump chamber 41 flows out toward the downstream side in the liquid supply flow path 27.

The pressurizing force caused by the liquid flowing out toward the downstream side in the liquid supply flow path 27 is transmitted to the liquid ejecting unit 12 via the liquid inflow portion 50, the communication path 57, and the liquid outflow portion 51 and thus the discharging operation (pressurization cleaning) in which liquid is discharged from the nozzle 19 is performed. Note that, in a case where the discharging operation is performed, it is preferable that the carriage 124 be moved such that the liquid ejecting unit 12 face the liquid receiving unit 131 and the liquid receiving unit 131 receive the discharged liquid as illustrated in FIG. 7.

Here, since the expansion and contraction portion 67 that presses the diaphragm 56 is displaced due to air pressure, a period of time between when the opening of the on-off valve 59 is started and when the opening of the on-off valve 59 is finished may vary. At a time when the on-off valve 59 starts to open the liquid supply flow path 27, the pressure in a region (an upstream side region) from the one-way valve 40 to the liquid inflow portion 50 is positive and the pressure in a region (a downstream side region) from the liquid outflow portion 51 to the nozzles 19 is negative. Therefore, when a time taken for movement of the valve portion 60 is long, liquid gradually flows into the communication path 57 in the middle of the movement and the pressure in the downstream side region is increased. In this case, the degree of fluctuation in pressure in the downstream side region which occurs when the pump mechanism 31 performs the discharge driving operation after the movement varies.

Furthermore, in a case where the pump mechanism 31 performs the discharge driving operation while the on-off valve 59 opens the liquid supply flow path 27, the amount of liquid flowing into the downstream side region from the liquid inflow portion 50 during the pressing operation (Step S14) is large in comparison with a case where the pump mechanism 31 is stopped while the on-off valve 59 opens the liquid supply flow path 27. In this manner, the pressure in the liquid ejecting unit 12 during the pressure operation may irregularly vary depending on a time for which the on-off valve 59 is operated and an operation state of the pump mechanism 31 at that time.

In the discharge driving operation, it is possible to efficiently discharge foreign substances accumulated in the liquid ejecting unit 12 by generating a large fluctuation in pressure in the liquid ejecting unit 12 within a short period of time. In addition, in order to press the foreign substances in the liquid ejecting unit 12 to cause the foreign substances to flow out to the outside of the nozzles 19, it is necessary to cause a predetermined amount or more of liquid to flow.

Therefore, when the pressure in the liquid ejecting unit 12 irregularly rises before the discharge driving operation, a sufficient amount of discharged liquid, a sufficient fluctuation in pressure, or a sufficient flow rate per unit time cannot be achieved at the time of the discharge driving operation and thus foreign substances mixed in liquid may not be sufficiently discharged.

In this regard, when the pump mechanism 31 performs the suction driving operation before the on-off valve 59 is opened, the pressure in the upstream side region is not likely to fluctuate during the pressing operation since the one-way valve 40 is closed. Therefore, even when a time taken for the on-off valve 59 to move in the pressing operation varies, it is possible to effectively pressurize the downstream side region at the time of the discharge driving operation performed thereafter.

In addition, when the volume of the pump chamber 41 becomes a set value in the suction driving operation before the on-off valve 59 opens the liquid supply flow path 27, the amount of liquid flowing out from the pump chamber 41 due to the discharge driving operation after the opening of the on-off valve 59 becomes constant. Therefore, an excessive amount of liquid does not flow from the nozzles 19 in the discharging operation and the amount of liquid does not become insufficient. Note that, in a case where it is desired that the amount of liquid flowing from the nozzles 19 in the discharging operation is small, the set value may be set to be small.

After the discharging operation, the discharge stopping operation of stopping the discharging operation is performed. In the discharge stopping operation, the pressing mechanism 48 is caused to stop pressing the diaphragm 56 such that the on-off valve 59 enters the closed state. Accordingly, the upstream side and the downstream side of the pressure adjustment mechanism 35 do not communicate with each other and pressurized liquid is not supplied from the liquid supply source 13 to the liquid ejecting unit 12. In addition, in the first embodiment, the discharging operation and the discharge stopping operation are repeatedly performed at short intervals. Accordingly, a decrease in flow rate of liquid flowing in the liquid supply flow path 27 and the liquid ejecting unit 12 during the discharging operation is suppressed and it becomes easy to remove foreign substances such as air bubbles in the liquid supply flow path 27 and the liquid ejecting unit 12.

Since a state immediately after the discharge stopping operation is a state in which the pressure in the liquid ejecting unit 12 disposed on the downstream side of the pressure adjustment mechanism 35 is high and is not suitable for the printing operation, the preceding wiping operation (the pressure reducing operation) is performed to reduce the pressure in the liquid ejecting unit 12.

Note that, immediately after the discharge stopping operation is performed, liquid continues to drop from the nozzle 19 and a state in which liquid is discharged from the nozzle 19 continues. Then, the liquid continues to be discharged from the nozzle 19 until the pressure in the liquid ejecting unit 12 is reduced and a meniscus is formed in the nozzle 19. The meniscus that is formed in the nozzle 19 or in the vicinity of the opening of the nozzle 19 in this case is a meniscus that is curved toward the outside of the nozzle 19 from the nozzle opening or the vicinity of the opening of the nozzle 19 instead of a meniscus that is formed in the nozzle 19 in a case where the printing operation is performed and that is curved toward the inside of the nozzle 19.

Figure 8:
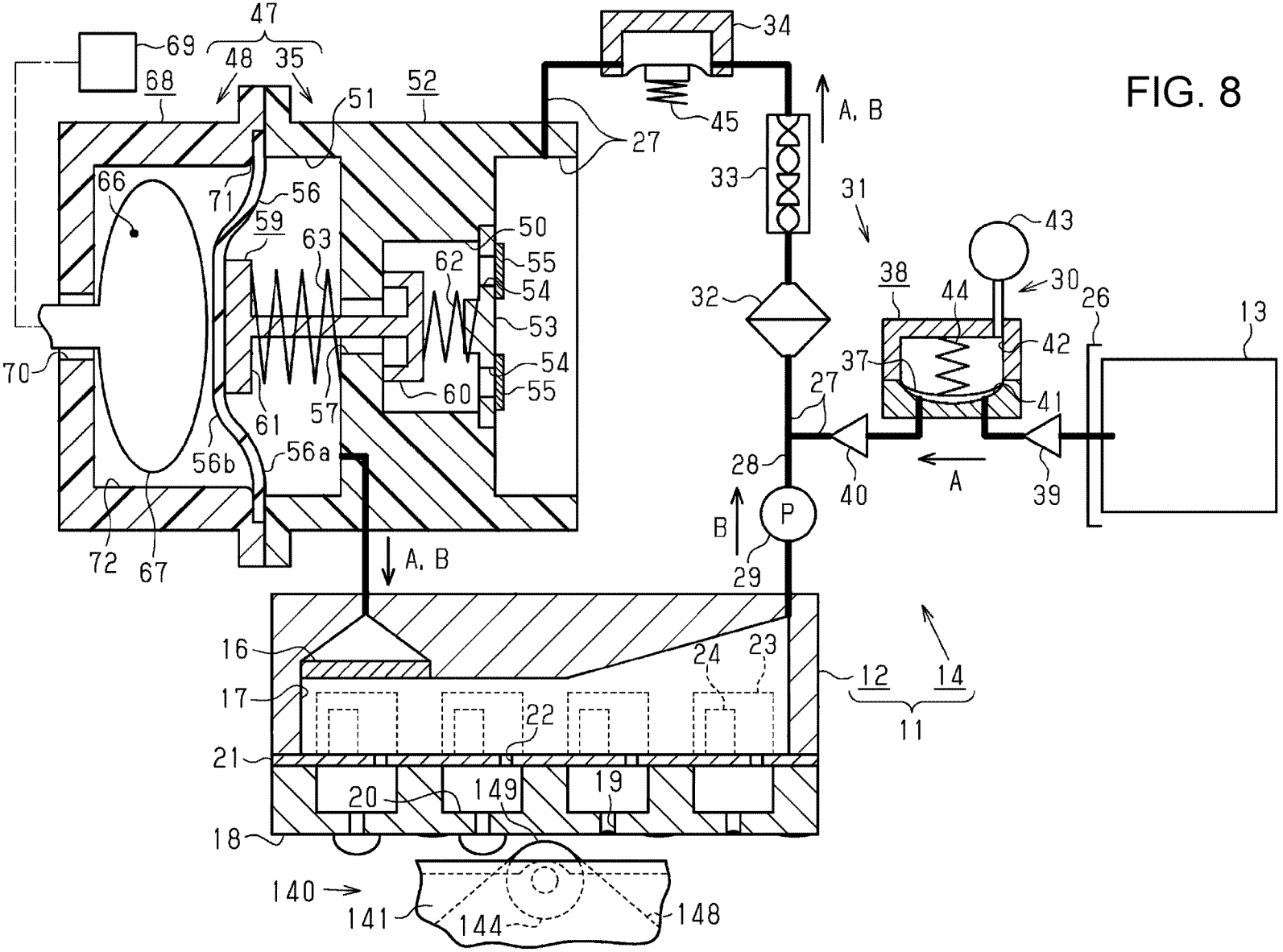
FIG. 8 is a schematic view of the pressure adjustment mechanism and the supply mechanism in the middle of a pressure reducing operation.

As described in FIG. 8, in the preceding wiping operation, the carriage 124 is moved such that the liquid ejecting unit 12 faces the wiping mechanism 140 and the wiping mechanism 140 wipes the liquid ejecting unit 12. At this time, since the pressure in the liquid ejecting unit 12 is a positive pressure, liquid leaks out from the nozzle 19 when the gas-liquid interface (a protruding meniscus) swelling toward the outside of the nozzle 19 comes into contact with the wiping portion 149. Note that, the purpose of the preceding wiping operation is to reduce the pressure in the liquid ejecting unit 12 by causing liquid to leak out from the nozzle 19. Therefore, as illustrated in FIG. 8, the wiping operation may be performed in a state where the gas-liquid interface swelling from the nozzle 19 is in contact with the wiping portion 149 while the nozzle surface 18 of the liquid ejecting unit 12 is not in contact with the wiping portion 149 and the wiping operation may be performed in a state where the nozzle surface 18 of the liquid ejecting unit 12 is in contact with the wiping portion 149.

Note that, a right-left direction in FIG. 8 corresponds to the vertical direction (the gravity direction) and the lower side in the vertical direction is a right side in FIG. 8.

Meanwhile, in a case where the cleaning is performed, air bubbles may not be discharged from the liquid ejecting unit 12 and the liquid supply flow path 27 in the discharging operation. In this case, in a state where the pressure of liquid is high in the discharging operation, the volume of air bubbles is small. However, after the discharge stopping operation, the pressure of liquid is reduced and thus the volume of air bubbles becomes large. Therefore, the pressure in the liquid ejecting unit 12 and the liquid supply flow path 27 when the meniscus is formed in the nozzle 19 may become higher due to a change in volume of air bubbles in the discharging operation and the discharge stopping operation.

If the wiping operation is performed in this state, the wiping portion 149 may come into contact with an unstable convex meniscus swelling from the nozzle opening such that the meniscus is broken and thus liquid in the nozzles 19 may spread over the nozzle surface 18. As described above, when the wiping operation is performed, the meniscus formed in the nozzle 19 may become unstable. With regard to this, a state where the pressure in the downstream side region including the inside of the liquid ejecting unit 12 is stable refers to a state where the pressure in the downstream side region is maintained at a negative pressure at which a meniscus is formed in the nozzles 19.

Figure 9:
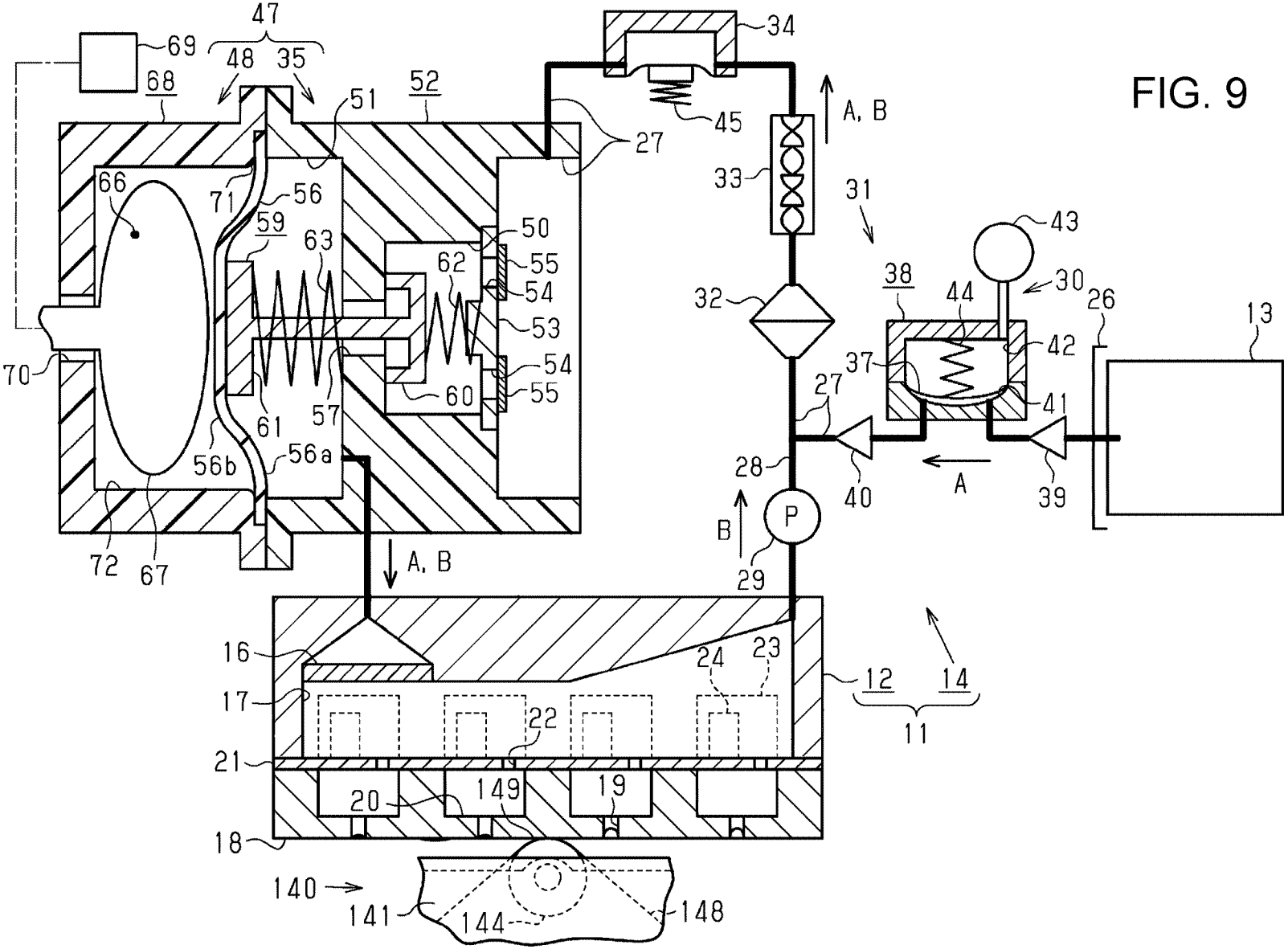
FIG. 9 is a schematic view of the pressure adjustment mechanism and the supply mechanism in the middle of a finishing wiping operation.

When the preceding wiping operation is finished and thus the pressure in the downstream side region becomes stable, the finishing wiping operation is performed. As illustrated in FIG. 9, in the finishing wiping operation, wiping is performed in a state where the wiping portion 149 of the fabric wiper 148 is in contact with the nozzle surface 18 of the liquid ejecting unit 12. In this manner, liquid adhering to the nozzle surface 18 of the liquid ejecting unit 12 is removed and a normal meniscus is formed in the nozzle 19 of the liquid ejecting unit 12.

Next, a method of manufacturing the pressure adjustment device 47 according to the first embodiment will be described.

First, the main body portion 52 in the first embodiment is formed of a light absorbing resin (for example, polypropylene or polybutylene terephthalate) which generates heat when absorbing laser light, or a resin colored with a dye which absorbs light. In addition, the diaphragm 56 is formed by laminating different materials such as polypropylene and polyethylene terephthalate and has transparency which allows laser light to pass therethrough and flexibility. In addition, the retaining member 68 is formed of a light-transmitting resin (for example, polystyrene or polycarbonate) which transmits laser light. That is, the transparency of the diaphragm 56 is greater than the transparency of the main body portion 52 and is lower than the transparency of the retaining member 68.

As illustrated in FIG. 4, first, the diaphragm 56 is interposed between the retaining member 68, in which a portion of the expansion and contraction portion 67 has been inserted into the insertion hole 70, and the main body portion 52 (an interposing step). Then, irradiation with laser light is performed via the retaining member 68 (an irradiation step). As a result, the laser light passing through the retaining member 68 is absorbed by the main body portion 52 and the main body portion 52 generates heat. The main body portion 52, the diaphragm 56, and the retaining member 68 are welded to each other due to the heat generated at this time. Therefore, the retaining member 68 also functions as a jig which presses the diaphragm 56 when the pressure adjustment device 47 is manufactured.

According to the above-described first embodiment, the following effects can be achieved.

(1-1) Since the pump mechanism 31 performs the suction driving operation before the maintenance such that the amount of liquid accommodated in the pump chamber 41 reaches the set value, a constant amount of liquid is discharged from the nozzles 19 at the time of the maintenance. Therefore, it is possible to perform favorable maintenance of the liquid ejecting unit 12.

(1-2) When the amount of liquid accommodated in the pump chamber 41 reaches the set value as a result of the suction driving operation of the pump mechanism 31, a constant amount of liquid is discharged from the nozzles 19 due to the discharge driving operation after the suction driving operation. Accordingly, it is possible to discharge the foreign substances in the liquid ejecting unit 12 to the outside of the nozzles 19 by causing liquid to appropriately flow at the time of the maintenance.

(1-3) When the pump mechanism 31 performs the suction driving operation before the pressure adjustment mechanism 35 opens the liquid supply flow path 27, a fluctuation in pressure caused by the liquid supply flow path 27 being opened or closed is not likely to be generated until the discharge driving operation after the suction driving operation. Therefore, it is possible to appropriately discharge the foreign substances in the liquid ejecting unit 12 at the time of the discharge driving operation.

(1-4) It is possible to open and close the liquid supply flow path 27 with the diaphragm 56 being displaced in accordance with a change in pressure in the liquid outflow portion 51 connected to the liquid ejecting unit 12.

(1-5) It is possible to forcibly open the liquid supply flow path 27 with the pressing mechanism 48 pressing the diaphragm 56.

(1-6) It is possible to forcibly open the liquid supply flow path 27 by adjusting the pressure in the pressure adjustment chamber 66.

(1-7) The pump mechanism 31 can perform the suction driving operation with the displacement mechanism 30 displacing the displacement portion 37 in a direction in which the volume of the pump chamber 41 is increased and can perform the discharge driving operation with the urging member 44 urging the displacement portion 37.

(1-8) It is possible to displace the displacement portion 37 by adjusting the pressure in the pressure reduction chamber 42. In this manner, the displacement mechanism 30 can displace the displacement portion 37 by means of air pressure. Therefore, in a case where the liquid ejecting apparatus 11 includes a plurality of displacement portions 37 corresponding to the type of liquid to be used, the plurality of displacement portions 37 can be displaced by one pressure reduction unit 43.

(1-9) Since the pressure reducing operation (the preceding wiping operation) is performed after the discharging operation is performed, it is possible to perform the finishing wiping operation in a state where the pressure in the liquid supply flow path 27 and the liquid ejecting unit 12 is lower than that at a time immediately after the discharge stopping operation is performed. That is, it is possible to perform the finishing wiping operation in a state where the pressure in the liquid supply flow path 27 and the liquid ejecting unit 12 is stable in comparison with a case where the finishing wiping operation is performed without performing the pressure reducing operation. In this manner, it is possible to suppress liquid being unstably ejected from the nozzle 19 after the discharging operation of discharging liquid from the nozzle 19 of the liquid ejecting unit 12 by supplying pressurized liquid to the liquid ejecting unit 12 is performed.

(1-10) The pressure in the liquid ejecting unit 12 is reduced such that the meniscus formed in the nozzle 19 is positioned in the nozzle 19 in the pressure reducing operation. Therefore, when the finishing wiping operation is performed, the meniscus being positioned outside the nozzle 19 is suppressed. Therefore, it is possible to suppress collapse of the meniscus formed in the nozzle 19 which occurs when the finishing wiping operation is performed.

(1-11) After the discharge stopping operation is performed, the meniscus may be positioned outside the nozzle 19 or in the vicinity of the opening of the nozzle 19. In this regard, in the first embodiment, it is possible to discharge liquid from the nozzle 19 by performing the preceding wiping operation such that the fabric wiper 148 (the wiping portion 149) comes into contact with the gas-liquid interface. Therefore, it is possible to reduce the pressure in the liquid ejecting unit 12.

(1-12) In the first embodiment, since the pressure adjustment mechanism 35 is provided in the middle of the liquid supply flow path 27, it is possible to adjust the pressure of liquid supplied to the liquid ejecting unit 12. In addition, it is possible to switch the state of the on-off valve 59 by changing whether the pressing mechanism 48 presses the diaphragm 56 of the pressure adjustment mechanism 35 or not. That is, it is possible to perform the discharging operation and the discharge stopping operation by changing whether the pressing mechanism 48 presses the diaphragm 56 or not.

(1-13) In the first embodiment, it is possible to cause liquid to flow into the liquid ejecting unit 12 and the liquid supply flow path 27 and to stop the liquid from flowing by repeatedly performing the discharging operation and the discharge stopping operation. As a result, it is easy to maintain the pressure of liquid flowing in the liquid ejecting unit 12 and the liquid supply flow path 27 at a high pressure in comparison with a case where the discharging operation is continuously performed. As a result, it is possible to effectively discharge foreign substances such as air bubbles contained in the liquid in the liquid ejecting unit 12 and the liquid supply flow path 27.

(1-14) In addition, since the pressure reducing operation is not repeatedly performed, it is possible to simplify a series of operations in comparison with a case where a series of operations including the discharging operation, the discharge stopping operation, and the pressure reducing operation is repeatedly performed.

Second Embodiment

Next, a second embodiment of the liquid ejecting apparatus 11 will be described with reference to drawings.

Figure 10:
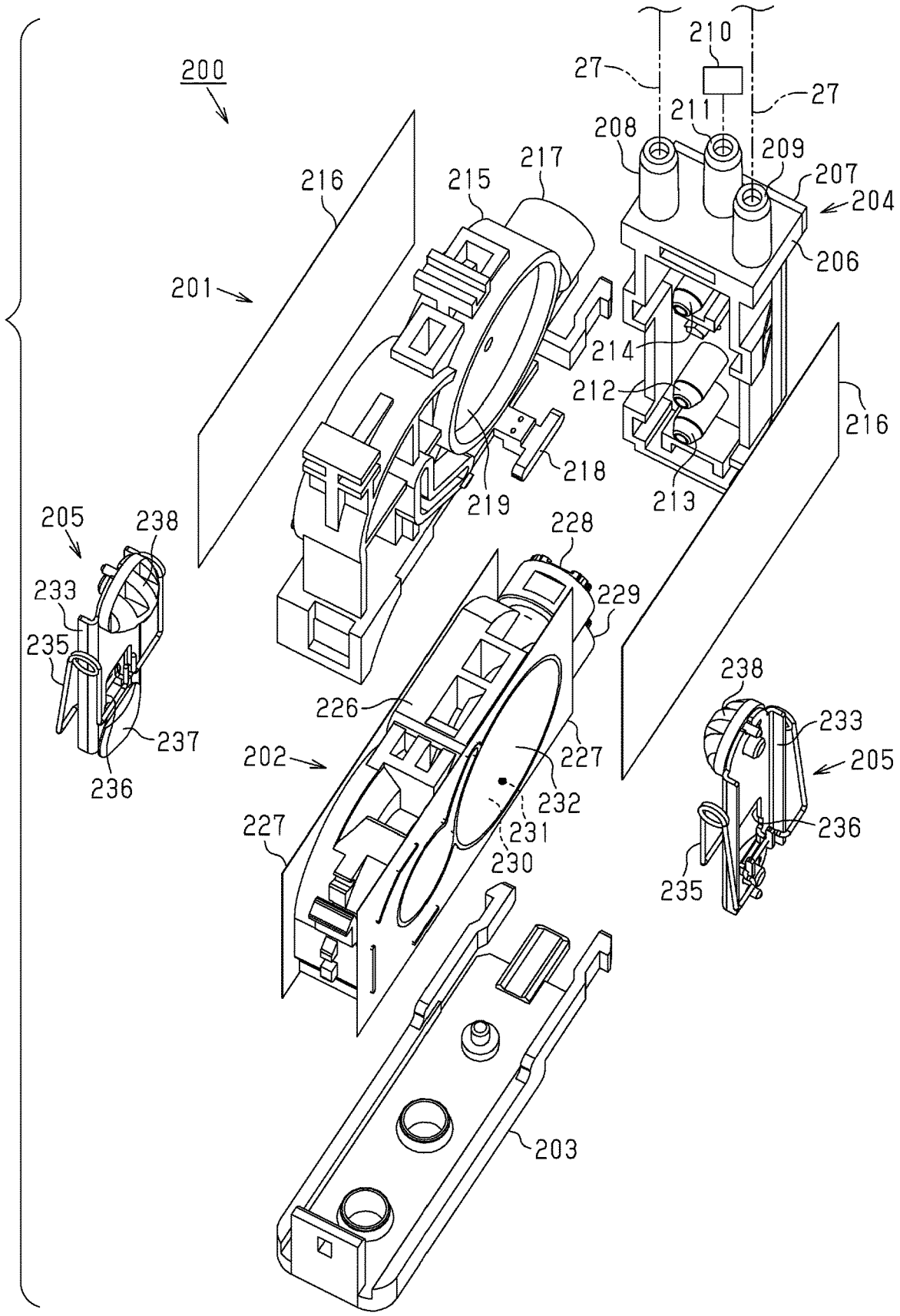
FIG. 10 is an exploded perspective view of a pressure adjustment mechanism according to a second embodiment.
Figure 11:
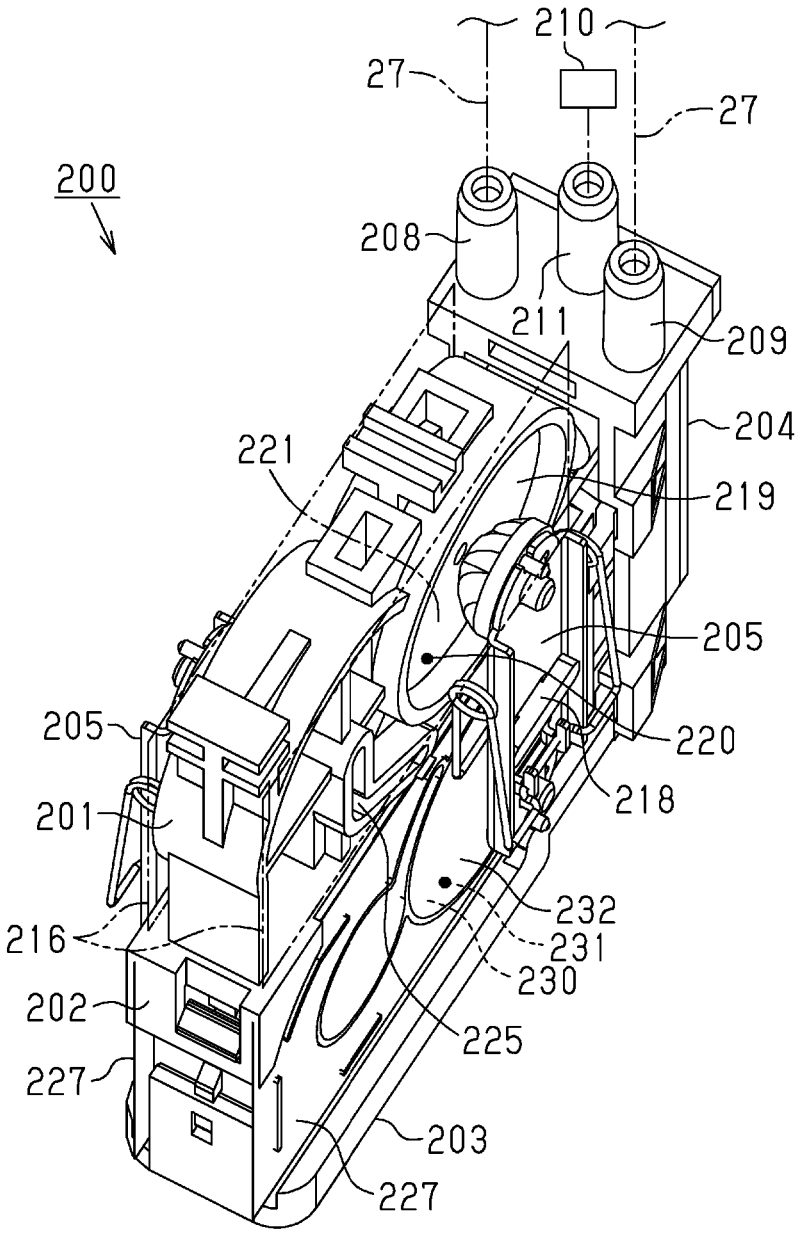
FIG. 11 is a perspective view of the pressure adjustment mechanism.

The second embodiment is obtained by changing the pressure adjustment device 47 in the first embodiment to a pressure adjustment device 200 as illustrated in FIGS. 10 and 11 and the second embodiment is the same as the first embodiment in other aspects. Therefore, the same members are given the same reference numerals and the repetitive description thereof will be omitted.

As illustrated in FIGS. 10 and 11, the pressure adjustment device 200 is formed by assembling an air chamber forming unit 201, a pressure adjustment mechanism forming unit 202, a bottom plate member 203, a connection portion forming unit 204, and two lever units 205.

The connection portion forming unit 204 includes a main body portion 206 and a connection film 207 that is attached such that the connection film 207 covers an outer surface of the main body portion 206. A first liquid connection portion 208 and a second liquid connection portion 209, to which two of the plurality of liquid supply flow paths 27 are respectively connected, and a pressure connection portion 211, to which a pressure adjustment unit 210 is connected, are provided to protrude from an upper surface of the main body portion 206. A first liquid outlet portion 212, a second liquid outlet portion 213, and a pressure supply portion 214, which respectively communicate with the first liquid connection portion 208, the second liquid connection portion 209, and the pressure connection portion 211, are provided to protrude from an inner surface of the main body portion 206.

Three grooves (not shown) are formed on the outer surface of the main body portion 206 of the connection portion forming unit 204 and the three grooves and the connection film 207 form three flow paths (not shown). The three flow paths (not shown) are respectively connected to the first liquid connection portion 208, the second liquid connection portion 209, the pressure connection portion 211, the first liquid outlet portion 212, the second liquid outlet portion 213, and the pressure supply portion 214.

The air chamber forming unit 201 includes a main body portion 215 and flexible air chamber films 216 that are respectively attached to opposite surfaces of the main body portion 215 such that the air chamber films 216 cover the entire portion of the opposite surfaces of the main body portion 215. An air inlet portion 217 to which the pressure supply portion 214 is connected is provided on a side surface of the main body portion 215 that is on the connection portion forming unit 204 side. Approximately T-shaped attachment portions 218 to which the lever units 205 are attached are provided in the vicinity of a boundary between the main body portion 215 and the pressure adjustment mechanism forming unit 202 such that each attachment portion 218 protrudes from each of the opposite surfaces of the main body portion 215.

Figure 12:
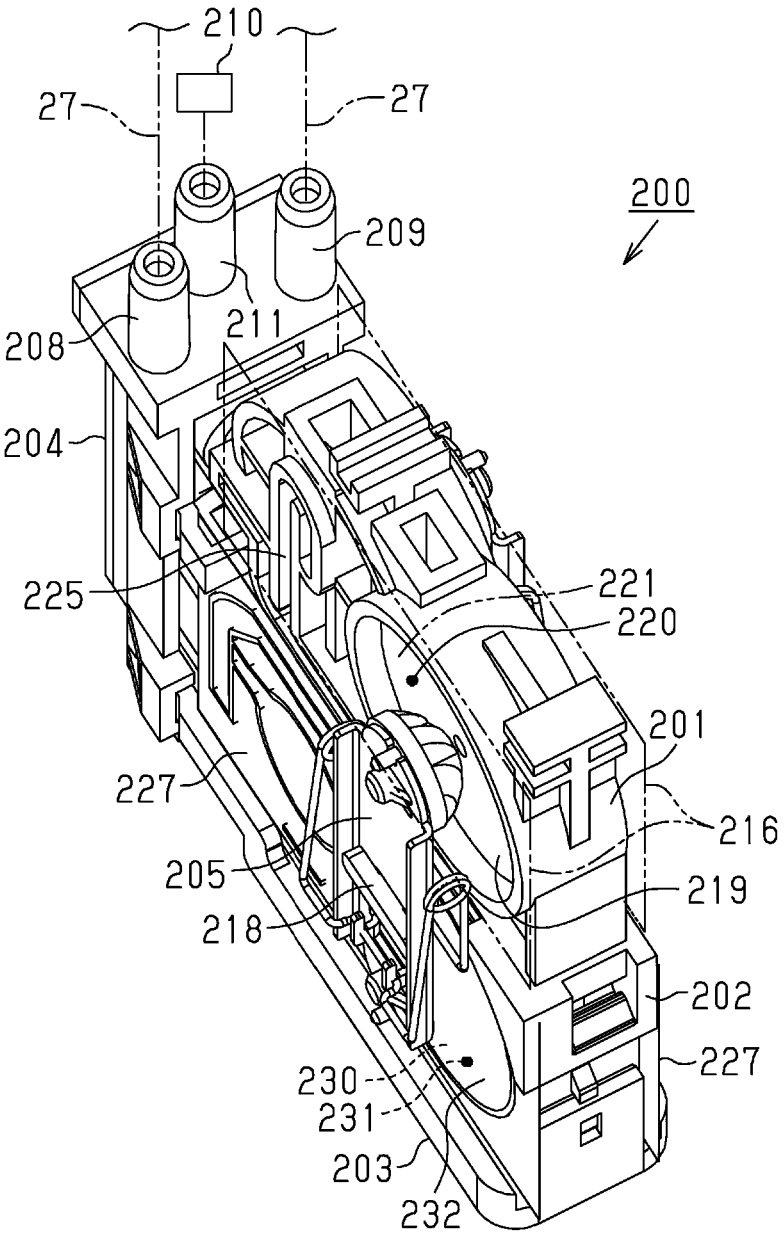
FIG. 12 is a perspective view of FIG. 11 as seen from a different angle.

As illustrated in FIGS. 10 and 12, a circular recess portion 219 is formed on each of the opposite surfaces of the main body portion 215 of the air chamber forming unit 201. In addition, a space surrounded by each recess portion 219 and each air chamber film 216 is a pressure adjustment chamber 220 which is an air chamber. A circular portion of each air chamber film 216 that corresponds to each recess portion 219 is a flexible wall 221 that forms a portion of the pressure adjustment chamber 220. In the second embodiment, the flexible wall 221 constitutes a "rotation force applying portion".

Figure 13:
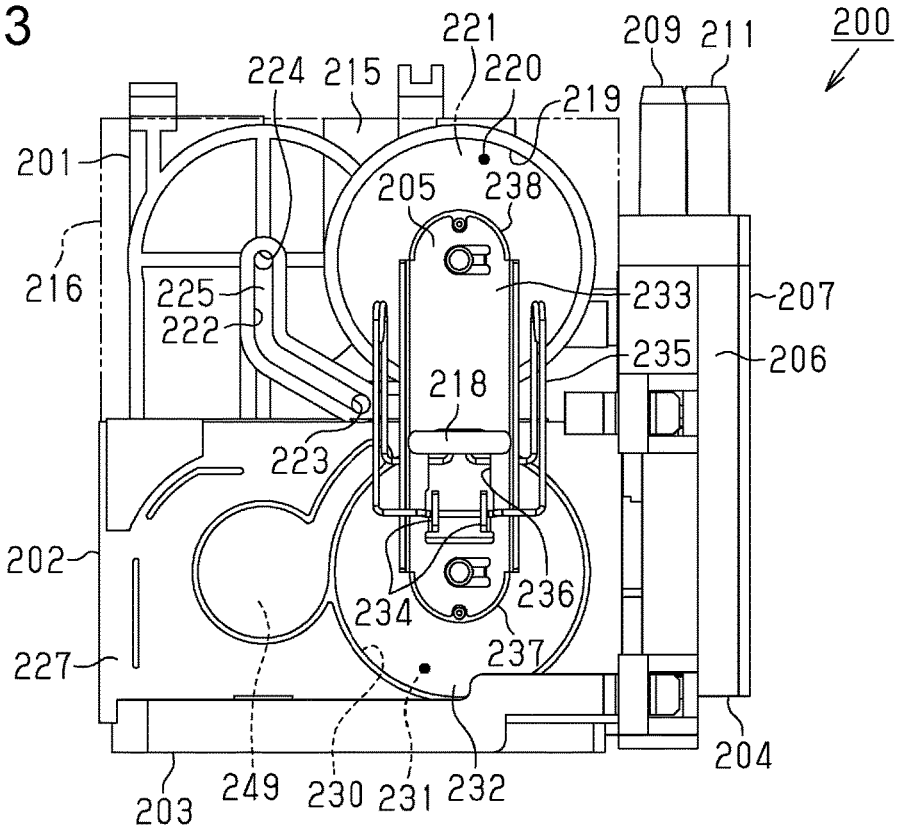
FIG. 13 is a side view of FIG. 11.
Figure 14:
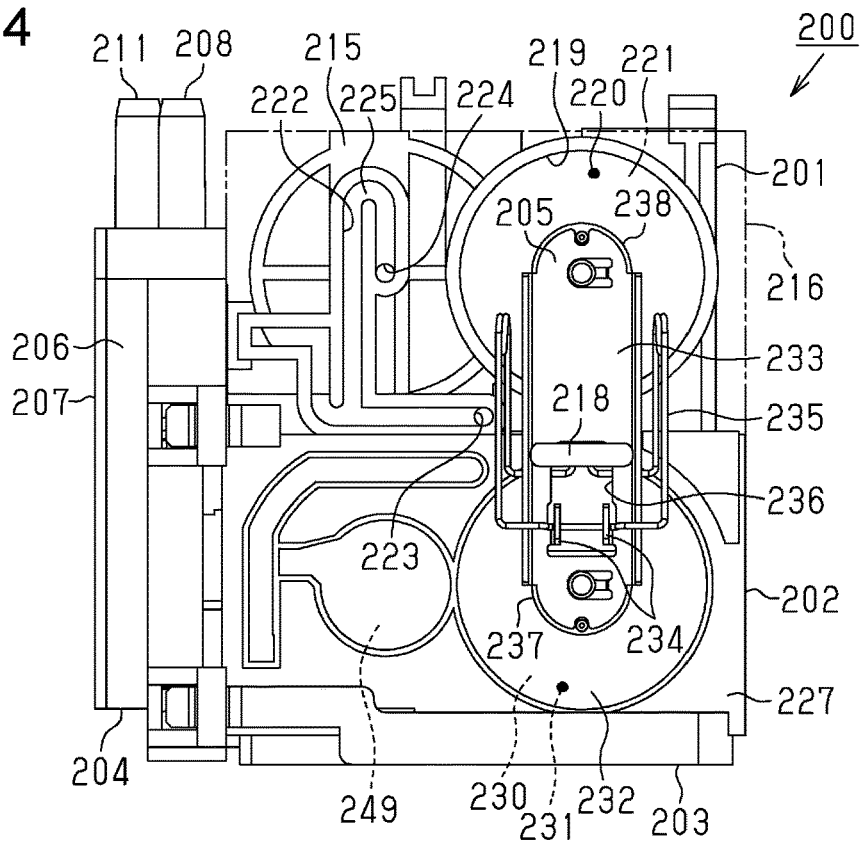
FIG. 14 is a side view of FIG. 13 as seen from an opposite side.

As illustrated in FIGS. 13 and 14, a groove 222 is formed on each of the opposite surfaces of the main body portion 215 of the air chamber forming unit 201 and the grooves 222 communicate with each other via a through hole 223. Each of the two grooves 222 communicates with a central portion of the recess portion 219 that is positioned opposite to each groove 222 via a through hole 224. In addition, a space surrounded by the two grooves 222 and the two air chamber films 216 forms an air flow path 225. Therefore, the air flow path 225 extends over the opposite surfaces of the main body portion 215. Note that, the air flow path 225 communicates with the air inlet portion 217.

As illustrated in FIG. 10, the pressure adjustment mechanism forming unit 202 includes a main body portion 226 and flexible pressure films 227 that are respectively attached to opposite surfaces of the main body portion 226 such that the pressure films 227 cover the entire portion of the opposite surfaces of the main body portion 226. A first liquid inlet portion 228 and a second liquid inlet portion 229 to which the first liquid outlet portion 212 and the second liquid outlet portion 213 are respectively connected are provided on a side surface of the main body portion 226 that is on the connection portion forming unit 204 side.

As illustrated in FIGS. 10 and 12, a circular recess portion 230 is formed on each of the opposite surfaces of the main body portion 226 of the pressure adjustment mechanism forming unit 202. In addition, a space surrounded by each recess portion 230 and each pressure film 227 is a liquid outflow portion 231. A circular portion of each pressure film 227 that corresponds to each recess portion 230 is a diaphragm 232 that forms a portion of the liquid outflow portion 231.

As illustrated in FIGS. 10 and 14, each lever unit 205 includes a rectangular plate-shaped lever 233 and a torsion spring 235 that is locked by a locking portion 234 of the lever 233. An attachment hole 236 for attaching the lever unit 205 to the attachment portion 218 is formed to penetrate a portion of the lever 233 that is closer to an end portion than a central portion in a longitudinal direction. The lever 233 includes an approximately circular plate-shaped pressing portion 237 that is provided on one end portion of one surface in the longitudinal direction and includes an approximately semi-spherical pressed portion 238 that is provided on the other end portion.

In addition, in a case where the lever unit 205 is attached to the attachment portion 218 via the attachment hole 236 of the lever 233, the lever unit 205 can rotate around a fulcrum which is a portion of the lever 233 that comes into contact with the attachment portion 218. At this time, the pressing portion 237 faces a central portion of the diaphragm 232 and the pressed portion 238 is in contact with a central portion of the flexible wall 221.

Furthermore, at this time, the urging force of the torsion spring 235 acts as a resistance force when the lever 233 is rotated in a direction in which the pressing portion 237 approaches the diaphragm 232. Therefore, the pressing portion 237 is generally separated from the diaphragm 232.

Figure 15:
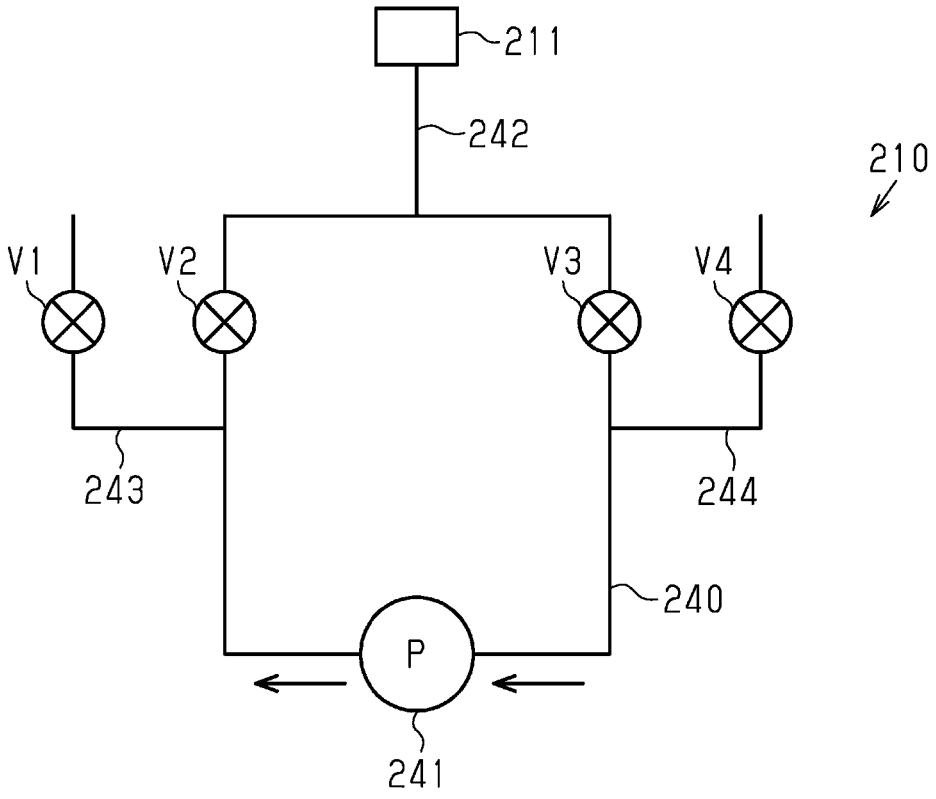
FIG. 15 is a schematic view of a pressure adjustment unit.

As illustrated in FIG. 15, the pressure adjustment unit 210 includes an annular pipe 240, a pump 241 that is provided in the middle of the annular pipe 240, and a connection pipe 242 that is provided in the annular pipe 240 to be positioned opposite the pump 241 and connects the annular pipe 240 and the pressure connection portion 211 to each other. A second valve V2 is provided between a position at which the connection pipe 242 is connected to the annular pipe 240 and the pump 241 and a third valve V3 is provided in the annular pipe 240 to be positioned opposite the second valve V2.

A base end side of a first branch pipe 243 of which a tip end side opens to the atmosphere is connected to a portion of the annular pipe 240 that is between the second valve V2 and the pump 241 and a first valve V1 is provided in the middle of the first branch pipe 243. A base end side of a second branch pipe 244 of which a tip end side opens to the atmosphere is connected to a portion of the annular pipe 240 that is between the third valve V3 and the pump 241 and a fourth valve V4 is provided in the middle of the second branch pipe 244.

When the pump 241 is driven, air in the annular pipe 240 flows in a direction illustrated by arrows in FIG. 15. In addition, the pressure adjustment unit 210 drives the pump 241 in a state where the first valve V1 and the third valve V3 are closed and the second valve V2 and the fourth valve V4 are open such that air is pressure-supplied from the pressure connection portion 211 and the pressure in the pressure adjustment chambers 220 (refer to FIGS. 11 and 12) is increased.

Meanwhile, the pressure adjustment unit 210 drives the pump 241 in a state where the first valve V1 and the third valve V3 are open and the second valve V2 and the fourth valve V4 are closed such that air is sucked from the pressure connection portion 211 and the pressure in the pressure adjustment chambers 220 (refer to FIGS. 11 and 12) is reduced.

Therefore, the pressure adjustment unit 210 functions as a pressure increasing and reducing device that can increase or decrease the pressure in the two pressure adjustment chambers 220 (refer to FIGS. 11 and 12) of the pressure adjustment device 200 at the same time. Note that, each of the first to fourth valves V1 to V4 is configured of a magnetic valve and an opening operation and a closing operation thereof are controlled by the controller 160.

Next, the pressure adjustment device 200 will be described in detail.

Here, the description will be made mainly based on FIGS. 4 and 16 and the description will be made on an assumption that the pressure adjustment device 47 in FIG. 4 has been replaced with the pressure adjustment device 200 illustrated in FIG. 16.

Figure 16:
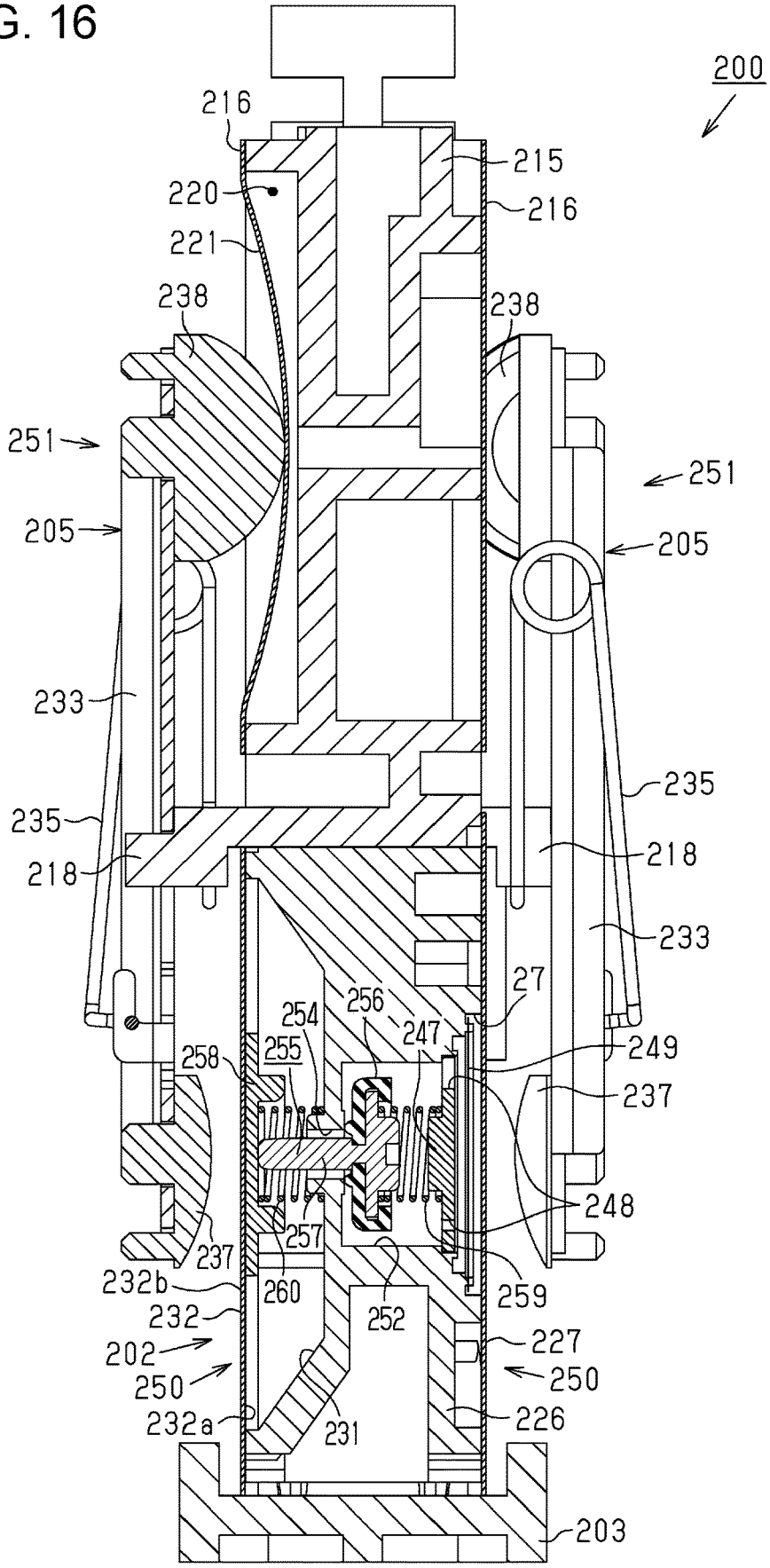
FIG. 16 is a sectional view of the pressure adjustment mechanism in a closed state.

As illustrated in FIGS. 4 and 16, the pressure adjustment device 200 includes two pressure adjustment mechanisms 250 that are provided in the liquid supply flow path 27 and that constitute a portion of the liquid supply flow path 27 and two pressing mechanisms 251 that press the pressure adjustment mechanisms 250. Therefore, one pressure adjustment device 200 can adjust the pressure of two types of liquid.

Each pressure adjustment mechanism 250 included in the pressure adjustment mechanism forming unit 202 includes the main body portion 226. In the main body portion 226, a liquid inflow portion 252 into which liquid that is supplied from the liquid supply source 13 via the liquid supply flow path 27 flows and the liquid outflow portion 231 that can accommodate the liquid are formed. The liquid supply flow path 27 and the liquid inflow portion 252 are separated from each other by a wall portion 247 and communicate with each other via through holes 248 formed in the wall portion 247.

Filter members 249 are disposed on the upstream side of the through holes 248 in the liquid supply flow path 27 and are disposed very close to the through holes 248. Therefore, liquid in the liquid supply flow path 27 flows into the liquid inflow portion 252 while being filtered by the filter members 249.

A portion of a wall surface of the liquid outflow portion 231 is configured of the diaphragm 232. A first surface 232*a* of the diaphragm 232, which is an inner surface of the liquid outflow portion 231, receives the pressure of liquid in liquid outflow portion 231 and a second surface 232*b*, which is an outer surface of the liquid outflow portion 231, receives atmospheric pressure.

Therefore, the diaphragm 232 is displaced in response to the pressure in the liquid outflow portion 231. The volume of the liquid outflow portion 231 changes when the diaphragm 232 is displaced. The liquid inflow portion 252 and the liquid outflow portion 231 communicate with each other via a communication path 254.

Each pressure adjustment mechanism 250 includes an on-off valve 255 that can switch between a closed state (a state illustrated in FIG. 16) in which the liquid inflow portion 252 and the liquid outflow portion 231 do not communicate with each other via the communication path 254 and an opened state (a state illustrated in FIG. 17) in which the liquid inflow portion 252 and the liquid outflow portion 231 communicate with each other.

The on-off valve 255 includes a valve portion 256 that can block the communication path 254 and a rod portion 257 that is inserted into the communication path 254. A tip end of the rod portion 257 comes into contact with an approximately circular plate-shaped pressure receiving portion 258 that is disposed such that the pressure receiving portion 258 comes into contact with a central portion of the first surface 232*a* of the diaphragm 232. In this case, the pressure receiving portion 258 may be fixed to the tip end of the rod portion 257 and may be fixed to the central portion of the first surface 232*a* of the diaphragm 232.

The on-off valve 255 moves when being pressed by the diaphragm 232 via the pressure receiving portion 258. That is, the pressure receiving portion 258 also functions as a moving member that can move in a state of being in contact with the diaphragm 56 that is displaced in a direction in which the volume of the liquid outflow portion 231 is reduced.

An upstream side urging member 259 is provided in the liquid inflow portion 252 and a downstream side urging member 260 is provided in the liquid outflow portion 231. The upstream side urging member 259 urges the on-off valve 255 in a direction in which the on-off valve 255 is closed and the downstream side urging member 260 urges pressure receiving portion 258 toward the diaphragm 232 side. The state of the on-off valve 255 is changed to the opened state from the closed state when a pressure applied to the first surface 232*a* is lower than a pressure applied to the second surface 232*b* and a difference between the pressure applied to the first surface 232*a* and the pressure applied to the second surface 232*b* is equal to or greater than a predetermined value P2 (for example, 1 kPa).

The predetermined value P2 is a value determined according to the urging force of the upstream side urging member 259, the urging force of the downstream side urging member 260, a force required to displace the diaphragm 232, a pressing force (sealing load) required to block the communication path 254 with the valve portion 256, the pressure in the liquid inflow portion 252 which acts on a surface of the valve portion 256, and the pressure in the liquid outflow portion 231. That is, the predetermined value P2 increases as the urging forces of the upstream side urging member 259 and the downstream side urging member 260 increase.

The urging forces of the upstream side urging member 259 and the downstream side urging member 260 are set such that the pressure in the liquid outflow portion 231 becomes a negative pressure (in a case where a pressure applied to the second surface 232*b* is atmospheric pressure, −1 kPa) at which a meniscus can be formed on a gas-liquid interface in the nozzle 19. In this case, the gas-liquid interface is a boundary at which the liquid and the gas are in contact with each other and the meniscus is a curved liquid surface which is generated when liquid comes into contact with the nozzle 19. In addition, it is preferable that a concave meniscus suitable for liquid ejection be formed in the nozzle 19.

Each pressing mechanism 251 includes the rotatable lever 233 including the pressing portion 237 that can push the second surface 232*b* of the diaphragm 232, the pressure adjustment chamber 220 including the flexible wall 221 that applies a rotation force to the lever 233, and the pressure adjustment unit 210 (refer to FIG. 11) that can adjust the pressure in the pressure adjustment chamber 220. The flexible wall 221 swells or dents in accordance with adjustment of the pressure in the pressure adjustment chamber 220 that is performed by the pressure adjustment unit 210 (refer to FIG. 11).

In addition, in the pressing mechanism 251, when the pressure adjustment unit 210 (refer to FIG. 11) adjusts the pressure in the pressure adjustment chamber 220 to be higher than the atmospheric pressure such that flexible wall 221 swells, the pressing portion 237 of the lever 233 presses the diaphragm 232 in a direction in which the volume of the liquid outflow portion 231 is reduced and thus the on-off valve 255 enters the opened state.

That is, when the flexible wall 221 swells in a state where the flexible wall 221 is in contact with the pressed portion 238 of the lever 233, the pressed portion 238 is pressed by the flexible wall 221, a rotation force is applied to the lever 233, and the lever 233 rotates around the fulcrum, which is a portion of the lever 233 that comes into contact with the attachment portion 218, due to the rotation force.

When the pressing portion 237 presses the second surface 232*b* of the diaphragm 232 in a direction in which the volume of the liquid outflow portion 231 is reduced in accordance with the rotation of the lever 233, the state of the on-off valve 255 is changed from the closed state to the opened state. At this time, the pressing portion 237 of the pressing mechanism 251 presses a region of the diaphragm 232 that comes into contact with the pressure receiving portion 258. In this case, the area of the region of the diaphragm 232 that comes into contact with the pressure receiving portion 258 is greater than the cross-sectional area of the communication path 254.

In addition, in the pressing mechanism 251, when the pressure adjustment unit 210 (refer to FIG. 11) adjusts the pressure in the pressure adjustment chamber 220 to be lower than the pressure in the pressure adjustment chamber 220 at a time when the pressing portion 237 of the lever 233 presses the diaphragm 232, the pressing portion 237 of the lever 233 stops to press the diaphragm 232. Note that, in a state where the rotation force from the flexible wall 221 is not applied to the lever 233, the pressing portion 237 is separated from the diaphragm 232.

Next, an operation of the pressure adjustment device 200 that adjusts the pressure of liquid supplied to the liquid ejecting unit 12 will be described.

When the liquid ejecting unit 12 ejects liquid, liquid accommodated in the liquid outflow portion 231 is supplied to the liquid ejecting unit 12 via the liquid supply flow path 27. As a result, the pressure in the liquid outflow portion 231 is reduced and when a difference between a pressure applied to the first surface 232*a* of the diaphragm 232 and a pressure applied to the second surface 232*b* becomes equal to or greater than the predetermined value P2, the diaphragm 232 is bent and deformed in a direction in which the volume of the liquid outflow portion 231 is reduced. The on-off valve 255 is pressed and moved via the pressure receiving portion 258 in accordance with the deformation of the diaphragm 232 and the on-off valve 255 enters the opened state.

Since the liquid in the liquid inflow portion 252 is pressurized by the pump mechanism 31, when the on-off valve 255 is opened, liquid flows into to the liquid outflow portion 231 from the liquid inflow portion 252. When the pressure in the liquid outflow portion 231 increases as a result of this, the diaphragm 232 is deformed in a direction in which the volume of the liquid outflow portion 231 increases. Then, when the difference between the pressure applied to the first surface 232*a* of the diaphragm 232 and the pressure applied to the second surface 232*b* becomes lower than the predetermined value P2, the on-off valve 255 is moved by the urging force of the upstream side urging member 259, the state of the on-off valve 255 changes to the closed state from the opened state, and liquid is inhibited from flowing.

In this manner, the pressure adjustment mechanism 250 adjusts the pressure of liquid supplied to the liquid ejecting unit 12 by means of displacement of the diaphragm 232 in order to adjust the pressure in the liquid ejecting unit 12 in which the nozzle 19 causes a back pressure.

Next, the effect pertaining to a case where the liquid ejecting apparatus 11 in the second embodiment performs the cleaning will be described. Note that, in the cleaning in the second embodiment, the discharging operation and the discharge stopping operation are not repeatedly performed.

As illustrated in FIG. 15, when the pump 241 is driven in a state where the first valve V1 and the third valve V3 of the pressure adjustment unit 210 are closed and the second valve V2 and the fourth valve V4 are open, air is pressure-supplied from the pressure connection portion 211 and the pressure in the pressure adjustment chamber 220 (refer to FIG. 16) is adjusted to be higher than the atmospheric pressure.

Figure 17:
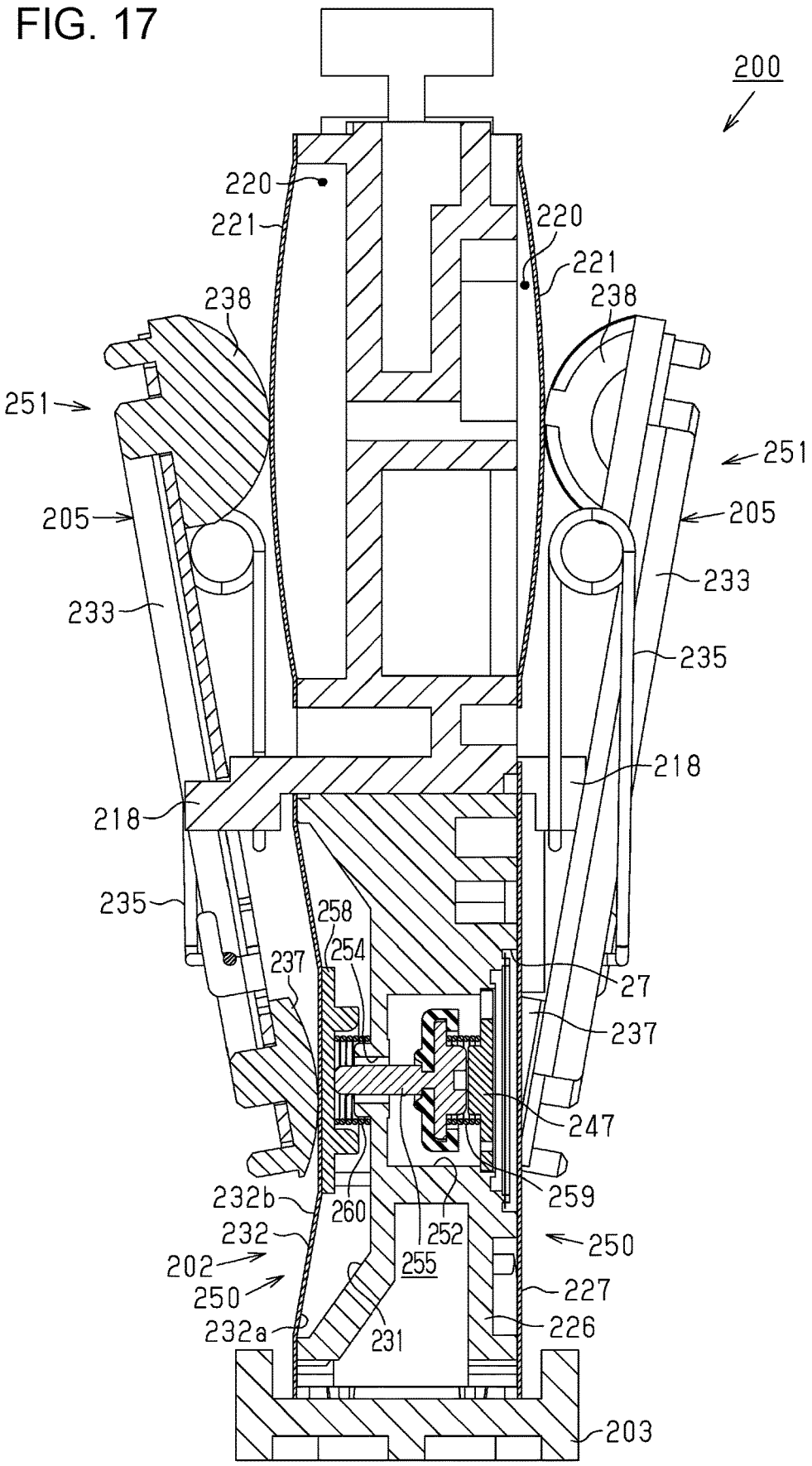
FIG. 17 is a sectional view of the pressure adjustment mechanism in an opened state.

As a result, as illustrated in FIG. 17, the flexible wall 221 swells and presses the pressed portion 238 of the lever 233 and thus the lever 233 rotates around the fulcrum, which is a portion of the lever 233 that comes into contact with the attachment portion 218, against the urging force of the torsion spring 235.

Then, the pressing portion 237 of the lever 233 presses a region of the diaphragm 232 that comes into contact with the pressure receiving portion 258 against the urging force of the downstream side urging member 260. As a result, the on-off valve 255 receives the pressing force of the pressing portion 237 via the diaphragm 232 and the pressure receiving portion 258 and also moves against the urging force of the upstream side urging member 259 such that the on-off valve 255 enters the opened state.

That is, the pressing mechanism 251 moves the pressure receiving portion 258 and the on-off valve 255 against the urging forces of the upstream side urging member 259 and the downstream side urging member 260 such that the on-off valve 255 enters the opened state. In this case, since the pressure adjustment unit 210 is connected to the pressure connection portions 211 of the plurality of pressure adjustment devices 200, all of the on-off valves 255 in the pressure adjustment devices 200 enter the opened state.

At this time, since the diaphragm 232 is displaced in a direction in which the volume of the liquid outflow portion 231 is reduced, liquid accommodated in the liquid outflow portion 231 is pressed out toward the liquid ejecting unit 12 side. That is, a pressure with which the diaphragm 232 presses the liquid outflow portion 231 is transmitted to the liquid ejecting unit 12 and thus the meniscus collapses and liquid flows out from the nozzle 19.

In other words, the pressing mechanism 251 presses the diaphragm 232 such that the pressure in the liquid outflow portion 231 becomes higher than a pressure at which at least one meniscus collapses (for example, a pressure at which a liquid side pressure becomes 3 kPa higher than an air side pressure in the gas-liquid interface).

In addition, the pressing mechanism 251 presses the diaphragm 232 such that the on-off valve 255 enters the opened state regardless of the pressure in the liquid inflow portion 252. In this case, the pressing mechanism 251 presses the diaphragm 232 with a pressing force that is greater than a pressing force that is generated in a case where a pressure, which is obtained by adding the above-described predetermined value P2 to a pressure at which the pump mechanism 31 pressurizes liquid, is applied to the diaphragm 232.

While the pressing mechanism 251 presses the diaphragm 232, the opened state of the on-off valve 255 is maintained. Therefore, if the pump mechanism 31 performs the discharge driving operation such that liquid flows out from the pump chamber 41, the pressurizing force is transmitted to the liquid ejecting unit 12 via the liquid inflow portion 252, the communication path 254, and the liquid outflow portion 231 and thus the discharging operation (pressurization cleaning) in which liquid is discharged (drops) from the nozzle 19 is performed. That is, a predetermined amount of pressurized liquid is supplied to the liquid ejecting unit 12 with the pump mechanism 31 pressurizing the liquid and is discharged from the nozzle 19 to the liquid receiving unit 131.

It is preferable that the pump mechanism 31 perform the suction driving operation and suck liquid until the amount of liquid accommodated in the pump chamber 41 reaches a set value, which is set in advance, before the pressing mechanism 251 presses the diaphragm 232. As a result, a constant amount of liquid can be supplied to the liquid ejecting unit 12 at a time when the pump mechanism 31 performs the discharge driving operation.

Then, when the constant amount (an amount of liquid in the pump chamber 41 corresponding to the set value) of liquid is discharged from the nozzle 19, discharge of liquid from the nozzle 19 is stopped. That is, when the pump mechanism 31 performs the discharge driving operation and thus the predetermined amount of pressurized liquid is discharged (drops) from the nozzle 19, the pressurization level with respect to liquid to be supplied is lowered in accordance with the discharge of liquid and becomes a pressurization level at which liquid cannot be discharged from the nozzle 19.

Thereafter, the first valve V1 and the third valve V3 of the pressure adjustment unit 210 are opened and the second valve V2 and the fourth valve V4 are closed so that air is sucked from the pressure connection portion 211 and the pressure in the pressure adjustment chamber 220 is reduced.

Accordingly, the swollen flexible wall 221 shrinks and is bent inward. As a result, the lever 233 rotates around the fulcrum, which is a portion of the lever 233 that comes into contact with the attachment portion 218, against the urging force of the torsion spring 235 and returns to an original position. That is, the pressing portion 237 of the lever 233 is separated from the diaphragm 232.

As a result, the pressure receiving portion 258 and the diaphragm 232 return to original positions due to the urging force of the downstream side urging member 260 and the on-off valve 255 moves due to the urging force of the upstream side urging member 259 and enters the closed state. Accordingly, the discharge stopping operation is performed with the upstream side, in which the pump mechanism 31 is provided, and the downstream side, in which the liquid ejecting unit 12 is provided, not communicating with each other due to the on-off valve 255 and pressurized liquid being not capable of being supplied to the liquid ejecting unit 12.

After the discharge stopping operation is performed, since the pressure in the liquid ejecting unit 12 is higher than usual, the pressure reducing operation is performed as with the first embodiment. Thereafter, the finishing wiping operation is performed and thus a normal meniscus is formed in the nozzle 19 of the liquid ejecting unit 12.

According to the above-described second embodiment, the following effects can be achieved.

(2-1) In the liquid ejecting apparatus 11, the pressure adjustment unit 210 in the pressing mechanism 251 adjusts the pressure in the pressure adjustment chamber 220 such that a rotation force is applied to the lever 233 by the flexible wall 221, the lever 233 rotates, and the pressing portion 237 presses the second surface 232*b* of the diaphragm 232. Therefore, it is possible to change the pressing force of the pressing portion 237 only by changing the specifications of the lever 233 (the lever ratio or the shape thereof) without changing the specifications of the pressure adjustment chamber 220 (the pressurizing force or the size thereof). That is, since it is possible to cope with a change in pressing force required for the pressing portion 237 only by changing the specifications of the lever 233 without changing the specifications of the pressure adjustment chamber 220, it is possible to achieve an improvement in versatility.

(2-2) In the liquid ejecting apparatus 11, in a state where a rotation force from the flexible wall 221 is not applied to the lever 233, the pressing portion 237 is separated from the diaphragm 232. Therefore, it is possible to suppress a malfunction of the pressure adjustment mechanism 250 which is caused by the pressing portion 237 of the lever 233 being in contact with the diaphragm 232.

(2-3) In the liquid ejecting apparatus 11, the pressing mechanism 251 presses a region of the diaphragm 232 that comes into contact with the pressure receiving portion 258 by using the pressing portion 237 of the lever 233. Therefore, it is possible to suppress the diaphragm 232 by using the pressing portion 237 such that a region of the diaphragm 232 that is on the outside of (in the vicinity of) the pressure receiving portion 258 is not deformed toward the liquid outflow portion 231 side. In addition, after the pressing portion 237 stops to press the diaphragm 232, the region of the diaphragm 232 that is on the outside of the pressure receiving portion 258 moves in a direction in which the volume of the liquid outflow portion 231 increases and returns to a state before being pressed. Therefore, it is possible to suppress air bubbles or liquid being attracted from the nozzle 19.

(2-4) In the liquid ejecting apparatus 11, the pressure adjustment unit 210 in the pressing mechanism 251 adjusts the pressure in the pressure adjustment chamber 220 to be higher than the atmospheric pressure such that the pressing portion 237 of the lever 233 presses the diaphragm 232. Therefore, it is possible to press the diaphragm 232 with the pressing portion 237 of the lever 233 only by adjusting the pressure in the pressure adjustment chamber 220 to be higher than the atmospheric pressure.

(2-5) In the liquid ejecting apparatus 11, the pressure adjustment unit 210 in the pressing mechanism 251 adjusts the pressure in the pressure adjustment chamber 220 to be lower than the pressure in the pressure adjustment chamber 220 at a time when the pressing portion 237 presses the diaphragm 232 such that the pressing portion 237 of the lever 233 stops to press the diaphragm 232. Therefore, it is possible to cause the pressing portion 237 of the lever 233 to stop pressing the diaphragm 232 with ease.

(2-6) In the liquid ejecting apparatus 11, the rotation force applying portion is the flexible wall 221 which forms a portion of the pressure adjustment chamber 220 and applies a rotation force to the lever 233 by coming into contact with the lever 233. Therefore, it is possible to cause the flexible wall 221 forming a portion of the pressure adjustment chamber 220 to preferably function as the rotation force applying portion that applies a rotation force to the lever 233.

(2-7) In the liquid ejecting apparatus 11, the pump mechanism 31 performs the discharge driving operation in a state where the on-off valve 255 is in the opened state with the pressing mechanism 251 pressing the diaphragm 232 such that the pressurized liquid is supplied to the liquid ejecting unit 12. Therefore, it is possible to perform the discharging operation of supplying pressurized liquid to the liquid ejecting unit 12 and discharging the liquid from the nozzle 19 with the pump mechanism 31 performing the discharge driving operation such that liquid is pressurized in a state where the on-off valve 255 has been forcibly opened.

(2-8) In the liquid ejecting apparatus 11, the pressing mechanism 251 is caused to stop pressing the diaphragm 232 in a state where liquid is pressurized due to the discharge driving operation of the pump mechanism 31 such that the on-off valve 255 enters the closed state. Therefore, it is possible to suppress air bubbles or liquid being attracted from the nozzle 19 after the pressurization cleaning.

The above-described embodiments may be modified as in the following modification examples. The components in the above-described embodiments may be randomly combined with components in the following modification examples. The components in the following modification examples may be randomly combined with each other.

Figure 18:
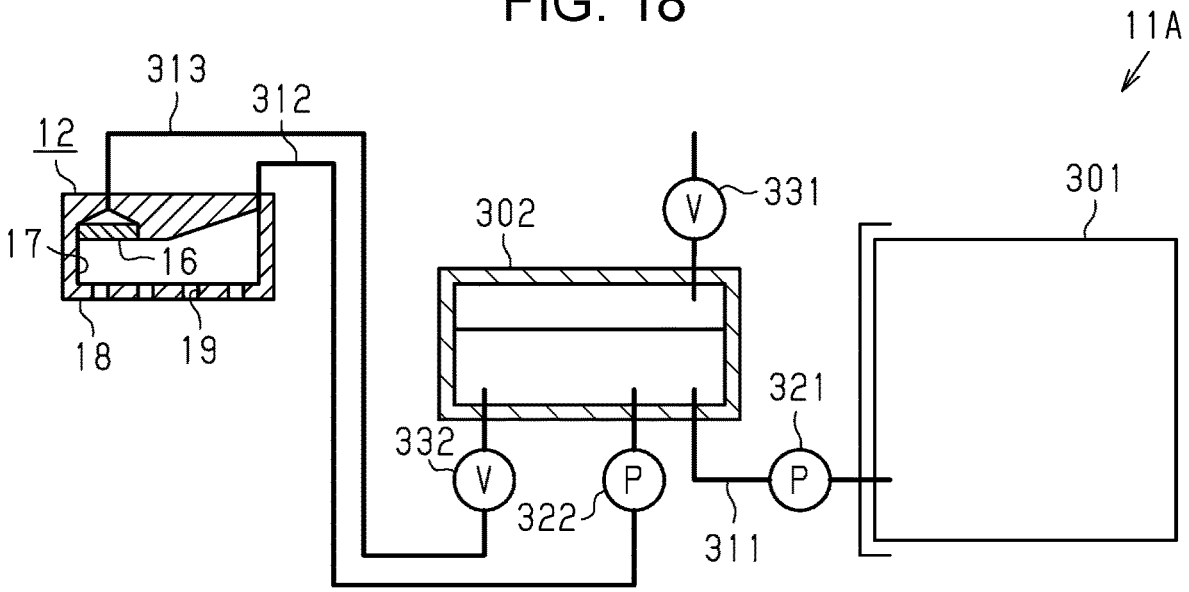
FIG. 18 is a schematic view of a liquid ejecting apparatus according to a first modification example.

As illustrated in FIG. 18, the liquid ejecting apparatus 11 may be a liquid ejecting apparatus 11A that does not include the pressure adjustment mechanism 35. The liquid ejecting apparatus 11A includes a main tank 301 (an example of a liquid supply source) that stores liquid, a sub tank 302 that stores liquid supplied from the main tank 301, and the liquid ejecting unit 12 that ejects liquid. In addition, the liquid ejecting apparatus 11A includes a first flow path 311 that connects the main tank 301 and the sub tank 302 to each other and a second flow path 312 and a third flow path 313 each of which connects the sub tank 302 and the liquid ejecting unit 12 to each other. In addition, the liquid ejecting apparatus 11A includes a first supply pump 321 that is disposed in the first flow path 311 and causes liquid to flow from the main tank 301 to the sub tank 302 and a second supply pump 322 that is disposed in the third flow path 313 and causes liquid to flow from the sub tank 302 to the liquid ejecting unit 12. Furthermore, the liquid ejecting apparatus 11A includes an atmosphere opening valve 331 that is connected to the sub tank 302 and switches a communication state between the inside of the sub tank 302 and the atmosphere (the outside) and a switching valve 332 that is disposed in the second flow path 312 and allows liquid to flow or restricts liquid from flowing.

In addition, in the liquid ejecting apparatus 11A, a positional relationship between the sub tank 302 and the liquid ejecting unit 12 in a vertical direction Z is a positional relationship in which the pressure in the liquid ejecting unit 12 (the pressure in the nozzle 19) can be maintained at a negative pressure by means of a difference in hydraulic head between a liquid surface in the sub tank 302 and a liquid surface in the nozzle 19 of the liquid ejecting unit 12.

In addition, in the liquid ejecting apparatus 11A, in a case where the printing operation is performed, liquid is ejected from the nozzle 19 of the liquid ejecting unit 12 based on the driving of the actuator 24. In addition, at the time of the printing operation, the switching valve 332 enters an opened state such that an amount of liquid corresponding to the amount of liquid ejected from the liquid ejecting unit 12 is supplied to the sub tank 302. When the printing operation is continued and thus the amount of liquid stored in the sub tank 302 decreases, the first supply pump 321 is driven and liquid is supplied from the main tank 301 to the sub tank 302. Note that, at the time of the printing operation, the atmosphere opening valve 331 enters an opened-to-atmosphere state and the second supply pump 322 is stopped.

Meanwhile, in the liquid ejecting apparatus 11A, in a case where the discharging operation is performed, the second supply pump 322 is driven in a state where the switching valve 332 is closed. Therefore, pressurized liquid is supplied into the liquid ejecting unit 12 via the second flow path 312 and thus liquid is discharged from the nozzle 19 of the liquid ejecting unit 12.

Figure 19:
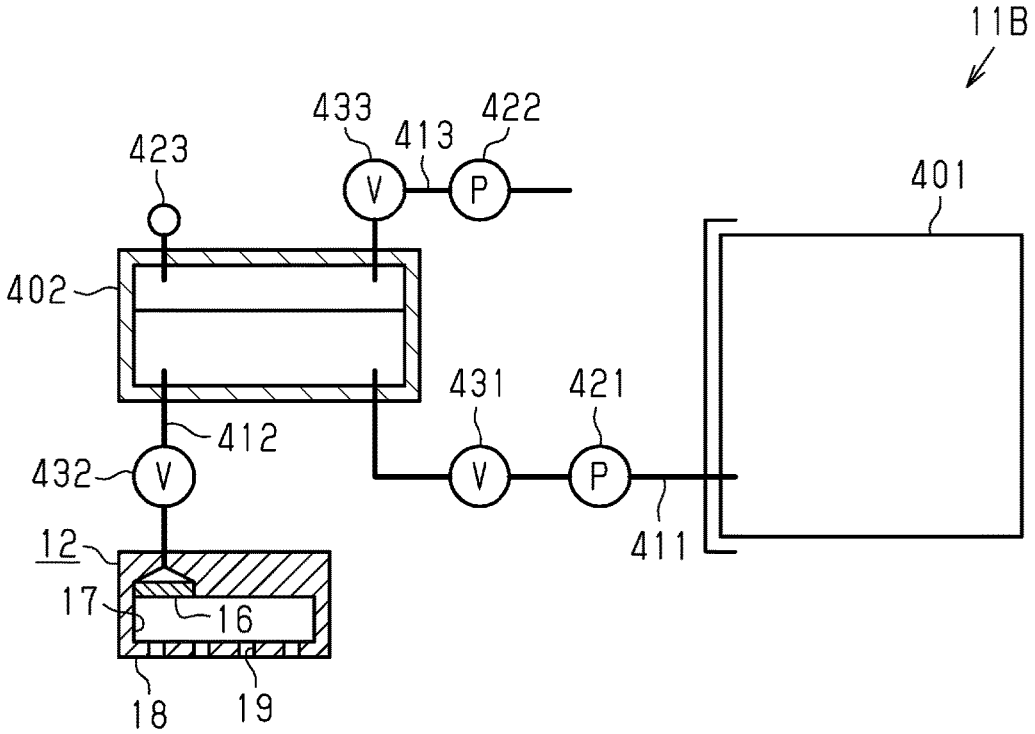
FIG. 19 is a schematic view of a liquid ejecting apparatus according to a second modification example.

In addition, as illustrated in FIG. 19, the liquid ejecting apparatus 11 may be a liquid ejecting apparatus 11B that does not include the pressure adjustment mechanism 35. The liquid ejecting apparatus 11B includes a main tank 401 (an example of a liquid supply source) that stores liquid, a sub tank 402 that stores liquid supplied from the main tank 401, and the liquid ejecting unit 12 that ejects liquid. Furthermore, liquid ejecting apparatus 11B is provided with a first flow path 411 that connects the main tank 401 and the sub tank 402 to each other, a second flow path 412 that connects the sub tank 402 and the liquid ejecting unit 12 to each other, and a third flow path 413 that is connected to a position higher than a liquid surface in the sub tank 402. In addition, the liquid ejecting apparatus 11B includes a supply pump 421 that is disposed in the first flow path 411 and causes liquid to flow from the main tank 401 to the sub tank 402, a pressure adjustment pump 422 that is disposed in the third flow path 413 and adjusts the pressure in the sub tank 402, and a pressure detecting unit 423 that measures the pressure in the sub tank 402. Furthermore, the liquid ejecting apparatus 11B includes a first switching valve 431 that switches a communication state between the main tank 401 and the sub tank 402, a second switching valve 432 that switches a communication state between the sub tank 402 and the liquid ejecting unit 12, and a three-way valve 433 that switches a connection state between the sub tank 402, the pressure adjustment pump 422, and the atmosphere (outside air). Note that, the first switching valve 431 is disposed in the first flow path 411, the second switching valve 432 is disposed in the second flow path 412, and the three-way valve 433 is disposed in the third flow path 413.

In addition, in the liquid ejecting apparatus 11B, in a case where the printing operation is performed, liquid is ejected from the nozzle 19 of the liquid ejecting unit 12 based on the driving of the actuator 24. In addition, at the time of the printing operation, the three-way valve 433 switches such that the sub tank 402 and the pressure adjustment pump 422 communicate with each other. In addition, the second switching valve 432 is closed and thus the main tank 401 and the sub tank 402 enter a disconnected state. In addition, the pressure adjustment pump 422 is driven such that the sub tank 402 has a predetermined pressure based on the result of detection performed by the pressure detecting unit 423. In this manner, at the time of the printing operation, liquid is supplied to the liquid ejecting unit 12 while the pressure in the nozzle 19 of the liquid ejecting unit 12 is maintained at a predetermined negative pressure. When the printing operation is continued and thus the amount of liquid stored in the sub tank 402 decreases, the supply pump 421 is driven and liquid is supplied from the main tank 401 to the sub tank 402. Note that, at a time when liquid is supplied to the sub tank 402, the first switching valve 431 is opened, the second switching valve 432 is closed, and the three-way valve 433 switches such that the sub tank 402 and the atmosphere communicate with each other.

Meanwhile, in the liquid ejecting apparatus 11B, in a case where the discharging operation is performed, the three-way valve 433 switches such that the sub tank 402 does not communicate with the atmosphere and the pressure adjustment pump 422. In addition, the second switching valve 432 is opened and the main tank 401 and thus the sub tank 402 enter a connected state. In addition, the supply pump 421 is driven in a state where the first switching valve 431 is open and pressurized liquid is supplied to the liquid ejecting unit 12 via the sub tank 402 such that liquid is discharged from the liquid ejecting unit 12.

Note that, in the liquid ejecting apparatus 11B, the discharging operation may be performed as follows. That is, in a case where the discharging operation is performed, the three-way valve 433 switches such that the sub tank 402 and the pressure adjustment pump 422 communicate with each other. In addition, the first switching valve 431 is closed and thus the main tank 401 and the sub tank 402 enter a disconnected state. In addition, the pressure adjustment pump 422 is driven such that air is fed into the sub tank 402 and the pressure in the sub tank 402 is increased. In this manner, pressurized liquid is supplied to the liquid ejecting unit 12 and liquid is discharged from the liquid ejecting unit 12.

The pressure reducing operation (Step S16) may not be the preceding wiping operation as long as it is possible to decrease the pressure in the liquid ejecting unit 12 by discharging pressurized liquid from the inside of the liquid ejecting unit 12.

For example, the pressure reducing operation may be an operation of displacing (vibrating) the vibration plate 21 by driving the actuator 24. In this case, it is possible to decrease the pressure in the liquid ejecting unit 12 by discharging liquid from the nozzle 19 in a state where the pressure in the liquid ejecting unit 12 is high and the gas-liquid interface in the nozzle 19 is unstable.

Note that, in a case where the actuator 24 is driven as the pressure reducing operation, a low voltage may be applied to the actuator 24 (a piezoelectric element) such that the vibration plate 21 is vibrated weakly. In this case, an unstable meniscus formed in the nozzle 19 collapses due to vibration of the vibration plate 21 and liquid leaks out from the nozzle 19. Note that, vibration in a case where the vibration plate 21 is vibrated weakly means vibration of the vibration plate 21 with which liquid is not ejected from the nozzle 19 even when a normal meniscus is formed in the nozzle 19.

Meanwhile, in a case where the actuator 24 is driven as the pressure reducing operation, a high voltage may be applied to the actuator 24 (a piezoelectric element) such that the vibration plate 21 is vibrated strongly. In this case, liquid is ejected from the nozzle 19 and thus it is possible to more reliably reduce the pressure in the liquid ejecting unit 12. Note that, vibration in a case where the vibration plate 21 is vibrated strongly means that vibration of the vibration plate 21 at a time when liquid is ejected to the medium 113 (for example, at the time of the printing operation).

In addition, the pressure reducing operation may be a combination of the preceding wiping operation and the operation of driving the actuator 24.

In the flowchart illustrated in FIG. 9, the controller 160 may perform the flushing after the finishing wiping operation is performed. In this case, a normal meniscus is likely to be formed in the nozzle 19 of the liquid ejecting unit 12.

In a case where the preceding wiping operation is performed with the wiping portion 149 coming into contact with the nozzle surface 18, the contact force of the wiping portion 149 with respect to the nozzle surface 18 in the preceding wiping operation and the finishing wiping operation may be appropriately changed. For example, the contact force of the wiping portion with respect to the nozzle surface 18 in the preceding wiping operation may be the same as that in the finishing wiping operation and may be weaker than that in the finishing wiping operation.

The liquid receiving unit 131 may be provided above the housing 141 of the wiping mechanism 140 in the vertical direction. In this case, it is possible to perform the pressure reducing operation without moving the carriage 124 (the liquid ejecting unit 12) after the discharging operation. Therefore, it is possible to suppress pressurized liquid leaking out from the nozzle 19 of the liquid ejecting unit 12 due to vibration acting on the liquid ejecting unit 12 when the carriage 124 (the liquid ejecting unit 12) moves.

The liquid receiving unit 131 may be configured of a movable belt that can receive liquid. In this case, it is preferable that a component such as a motor for driving the belt be provided such that a portion of the belt that has received liquid can be changed to a portion of the belt that has not received liquid.

The pressing mechanism 48 may press the diaphragm 56 by adjusting the pressure in the air chamber 72 without including the expansion and contraction portion 67. Specifically, the pressing mechanism 48 may displace the diaphragm 56 in a direction in which the volume of the liquid outflow portion 51 is reduced by increasing the pressure in the air chamber 72 and may displace the diaphragm 56 in a direction in which the volume of the liquid outflow portion 51 is increased by reducing the pressure in the air chamber 72. Note that, in a case where this configuration is adopted, as the pressure reducing operation, the pressure in the air chamber 72 may be reduced to a negative pressure lower than the atmospheric pressure such that the pressure in the liquid ejecting unit 12 is reduced.

A buffer tank into which liquid flows and from which liquid flows out may be provided between the pressure adjustment mechanism 35 and the liquid ejecting unit 12. In this case, it is preferable that a portion of a wall portion of the buffer tank be an elastically deformable flexible wall and a displacement mechanism for displacing the flexible wall be provided such that the volume of the buffer tank can be changed. In this case, it is possible to perform the pressure reducing operation by increasing the volume of the buffer tank after the discharging operation is performed in a state where the volume of the buffer tank has been reduced.

The pump mechanism 31 may be driven at the time of the suction cleaning. In this case, since the pressurizing force of the pump mechanism 31 is added to the suctioning force of the suction mechanism 153, the flow rate at the time of liquid discharge is increased and thus it is possible to more efficiently discharge the foreign substances such as air bubbles. In this case, the pump mechanism 31 may perform the suction driving operation and suck liquid until the amount of liquid accommodated in the pump chamber 41 reaches a set value, which is set in advance, before the suction cleaning. The set value is, for example, the full capacity of the pump chamber 41. Then, at the same time as when the suction mechanism 153 is driven or before or after the suction mechanism 153 is driven, the pump mechanism 31 performs the discharge driving operation. Accordingly, it is possible to suppress a variation in pressurizing force for discharging liquid.

Note that, the pressure in the upstream side region changes depending on whether the pump mechanism 31 performs the suction driving operation or the discharge driving operation before the suction cleaning. Such a difference in pressure in the liquid supply flow path 27 may cause a fluctuation in flow rate of liquid when the suction mechanism 153 is driven. Therefore, even in a case where the pump mechanism 31 is not driven at the time of the suction cleaning, the pump mechanism 31 may perform the suction driving operation and suck liquid until the amount of liquid accommodated in the pump chamber 41 reaches a set value, which is set in advance, before the suction cleaning.

In a case where the discharge driving operation is performed with respect to the second supply pump 322 in FIG. 18, the supply pump 421 in FIG. 19, or the pressure adjustment pump 422 such that the discharging operation is performed, the suction driving operation may be performed before the discharge driving operation such that the amount of liquid accommodated in the pump chamber becomes a set value, which is set in advance. Accordingly, it is possible to suppress a variation in amount of liquid discharged in the discharging operation.

In a case where a group of a plurality of nozzles 19 ejecting the same type of liquid is provided as a nozzle group, the liquid ejecting unit 12 may include a plurality of nozzles groups which eject different types of liquid. In this case, the cap 151 may be provided for each nozzle group such that the pressurization cleaning is individually performed for each nozzle group. Similarly, the pressurization cleaning may be individually performed for each nozzle group. In a case where pressurization or the suction cleaning is performed for each nozzle group, in the suction driving operation of the pump mechanism 31 that is performed before the pressurization or the suction cleaning, different set values may be set for the nozzle groups such that the amounts of liquid accommodated in the pump chambers 41 become different from each other. According to this configuration, it is possible to clean the liquid ejecting unit 12 with an appropriate amount of discharged liquid, an appropriate fluctuation in pressure, or an appropriate flow rate per unit time corresponding to the type of liquid or the use state.

On the contrary, in a case where one cap 151 covers the plurality of nozzles which eject different types of liquid, it is preferable that the same set value at the time of the suction driving operation be set for all of the nozzle groups. In this case, since liquid is discharged from all of the nozzle groups under the same condition in the discharge driving operation after the suction driving operation. Therefore, a risk of intrusion of a liquid mixture into the nozzles 19 becomes low.

The liquid ejecting apparatus 11 may be a liquid ejecting apparatus that ejects or discharges liquid other than ink. The liquid discharged in the form of very small amounts of droplets from the liquid ejection apparatus may be in a granular shape, a teardrop shape or a tailed thread-like shape. In addition, the liquid herein may be any material that can be ejected from the liquid ejecting apparatus. The liquid may be any material in the liquid phase and may include liquid-state materials having a high viscosity or a low viscosity, sols, aqueous gels and other fluid-state materials including inorganic solvents, organic solvents, solutions, liquid resins and liquid metals (metal melts). The liquid is not limited to the liquid state as one of the three states of matter but includes solutions, dispersions and mixtures of the functional solid material particles, such as pigment particles or metal particles, solved in, dispersed in or mixed with a solvent. Typical examples of the liquid include various liquid compositions such as water-based ink, non-water-based ink, oil-based ink, gel ink and hot-melt ink, and crystals as described in the embodiments. Specific examples of the liquid ejecting apparatus include a liquid ejecting apparatus that ejects liquid in the form of a dispersion or a solution containing a material such as an electrode material or a color material used for production of liquid crystal displays, EL (electroluminescent) displays, surface emission displays and color filters. The liquid ejecting apparatus may also be a liquid ejecting apparatus that ejects a bioorganic material used for manufacturing biochips, a liquid ejecting apparatus that is used as a precision pipette and ejects liquid as a sample, a printing apparatus or a micro dispenser. Furthermore, the liquid ejecting apparatus may be a liquid ejecting apparatus that ejects lubricating oil on precision machines such as clocks and cameras in a pin-point manner or a liquid ejecting apparatus that ejects a transparent resin solution of, for example, an ultraviolet curable resin, onto a substrate to form a hemispherical micro lens (an optical lens) used for optical communication elements and the like. In addition, the liquid ejecting apparatus may be a liquid ejecting apparatus that ejects an acidic or alkaline etching solution to etch a substrate or the like.

The medium 113 is not limited to a paper sheet and may be a plastic film, a thin plate material, or a fabric used for printing equipment or the like. The medium 113 may be a clothing having a random shape such as a T-shirt, or a three-dimensional object having a random shape such as dishes or stationery.

The entire disclosure of Japanese Patent Application No. 2017-110243, filed Jun. 2, 2017 is expressly incorporated by reference herein.

What is claimed is:

1. A liquid ejecting apparatus comprising:

a liquid ejecting unit provided with a nozzle from which liquid is ejected;

a liquid supply flow path connected to a liquid supply source and the liquid ejecting unit;

a pump mechanism including a pump chamber provided in the liquid supply flow path and configured to repeat a suction driving operation to suck the liquid from the liquid supply source into the pump chamber and a discharge driving operation to discharge the amount of liquid in the liquid chamber toward the liquid ejecting unit such that the liquid flows toward the liquid ejecting unit from the liquid supply source;

an on-off valve provided between the pump chamber and the liquid ejecting unit in the liquid supply flow path and configured to open and close the liquid supply flow path; and a controller configured to control the pump mechanism, wherein, during a maintenance operation, the controller causes the pump mechanism to perform the suction driving operation until the amount of liquid accommodated in the pump chamber reaches a set value, which is set in advance, after the suction driving operation, the controller causes the on-off valve to open the liquid supply flow path in a state in which the liquid in the liquid chamber is not discharged toward the liquid ejecting unit, and after the liquid supply flow path is opened, the controller causes the pump mechanism to perform the discharging driving operation to discharge the amount of liquid in the liquid chamber.

2. The liquid ejecting apparatus according to claim 1, further comprising:

a pressure adjustment mechanism that adjusts a pressure in the liquid ejecting unit by opening and closing the liquid supply flow path between the pump chamber and the liquid ejecting unit, wherein the pressure adjustment mechanism includes a liquid inflow portion that is disposed in the liquid supply flow path, a liquid outflow portion that is disposed in the liquid supply flow path between the liquid inflow portion and the liquid ejecting unit, a diaphragm that constitutes a portion of a wall surface of the liquid outflow portion, and the on-off valve that opens and closes the liquid supply flow path between the liquid inflow portion and the liquid outflow portion, and wherein, the on-off valve opens the liquid supply flow path when a pressure applied to a first surface of the diaphragm is lower than a pressure applied to a second surface and a difference between the pressure applied to the first surface and the pressure applied to the second surface is equal to or greater than a predetermined value, the first surface being a surface of the diaphragm that is close to the inside of the liquid outflow portion and the second surface being a surface opposite to the first surface.

3. The liquid ejecting apparatus according to claim 2, further comprising:

a pressing mechanism that causes the on-off valve to open the liquid supply flow path by pressing the diaphragm in a direction in which the volume of the liquid outflow portion is decreased.

4. The liquid ejecting apparatus according to claim 3, wherein the pressing mechanism includes a pressure adjustment chamber formed to be close to the second surface of the diaphragm and a pressure adjustment unit that adjusts the pressure in the pressure adjustment chamber and the pressure adjustment unit adjusts the pressure in the pressure adjustment chamber to be higher than an atmospheric pressure such that the diaphragm is pressed.

5. The liquid ejecting apparatus according to claim 1, wherein the pump mechanism includes a first one-way valve that is provided between the liquid supply source and the pump chamber in the liquid supply flow path, allows liquid to flow into the pump chamber, and restrains liquid from flowing out from the pump chamber, a second one-way valve that is provided between the pump chamber and the on-off valve in the liquid supply flow path, allows liquid to flow out from the pump chamber, and restrains liquid from flowing into the pump chamber, a displacement portion that constitutes a portion of a wall surface of the pump chamber and is displaced in a direction in which the volume of the pump chamber is changed, a pressure reduction unit that displaces the displacement portion in a direction in which the volume of the pump chamber is increased, and an urging member that urges the displacement portion in a direction in which the volume of the pump chamber is decreased, wherein during the maintenance operation, after the suction driving operation, the controller causes the on-off valve to open the liquid supply flow path in the state in which the second one-way valve closes the liquid supply flow path.

6. The liquid ejecting apparatus according to claim 5, wherein the pressure reduction unit is provided with a pressure reduction chamber that is separated from the pump chamber by the displacement portion and the pressure reduction unit displaces the displacement portion in the direction in which the volume of the pump chamber is increased by reducing a pressure in the pressure reduction chamber.

7. A maintenance method for a liquid ejecting apparatus which includes a liquid ejecting unit provided with a nozzle from which liquid is ejected, a liquid supply flow path connected to a liquid supply source and the liquid ejecting unit, a pump mechanism including a pump chamber provided in the liquid supply flow path and configured to repeat a suction driving operation to suck the liquid from the liquid supply source into the pump chamber and a discharge driving operation to discharge the amount of liquid in the liquid chamber toward the liquid ejecting unit such that the liquid flows toward the liquid ejecting unit from the liquid supply source, and an on-off valve provided between the pump chamber and the liquid ejecting unit in the liquid supply flow path and configured to open and close the liquid supply flow path, the method comprising:

performing the suction driving operation by the pump mechanism until the amount of liquid accommodated in the pump chamber reaches a set value;

performing an opening operation in which the on-off valve opens the liquid supply flow path in a state in which the liquid in the liquid chamber is not discharged toward the liquid ejecting unit after the suction driving operation; and performing the discharge driving operation by the pump mechanism after the opening operation such that the liquid is discharged from the nozzle.

8. The maintenance method according to claim 7, wherein the pump mechanism further includes a second one-way valve that is provided between the pump chamber and the on-off valve in the liquid supply flow path, allows liquid to flow out from the pump chamber, and restrains liquid from flowing into the pump chamber, and wherein the opening operation is performed in the state in which the second one-way valve closes the liquid supply flow path after the suction driving operation.

* * * * *